US009102144B2

(12) United States Patent
Nishihara

(10) Patent No.: US 9,102,144 B2
(45) Date of Patent: Aug. 11, 2015

(54) LIQUID CONSUMING APPARATUS AND CONTROL METHOD FOR LIQUID CONSUMING APPARATUS

(71) Applicant: Seiko Epson Corporation, Tokyo (JP)

(72) Inventor: Yuichi Nishihara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 13/900,287

(22) Filed: May 22, 2013

(65) Prior Publication Data

US 2013/0321505 A1 Dec. 5, 2013

(30) Foreign Application Priority Data

May 31, 2012 (JP) ..... 2012-124298

(51) Int. Cl.
*B41J 2/125* (2006.01)
*B41J 2/175* (2006.01)

(52) U.S. Cl.
CPC ..... *B41J 2/125* (2013.01); *B41J 2/17513* (2013.01); *B41J 2/17546* (2013.01); *B41J 2/17553* (2013.01); *B41J 2/17566* (2013.01)

(58) Field of Classification Search
CPC ..... B41J 2/125; B41J 2/17566; B41J 2/175; B41J 2/17503; B41J 2002/17566; B41J 2002/17569; B41J 2002/17573; B41J 2002/17589
USPC ..... 347/5, 9, 14, 19, 86, 7
See application file for complete search history.

(56) References Cited

U.S. PATENT DOCUMENTS 6,012,795 A * 1/2000 Saito et al. ..... 347/7
2005/0024454 A1* 2/2005 Hayamizu et al. ..... 347/86
2011/0032317 A1* 2/2011 Hatasa et al. ..... 347/86

FOREIGN PATENT DOCUMENTS

JP 05-332812 A 12/1993

* cited by examiner

*Primary Examiner* — Geoffrey Mruk
*Assistant Examiner* — Scott A Richmond

(57) ABSTRACT

A printing apparatus includes a liquid receptacle, a head, a driving unit for the head, a detection unit that detects a remaining state of a liquid, and a control unit that controls the driving unit and, in the case where the liquid receptacle and the detection unit are in a predetermined positional relationship, determines whether or not there is liquid remaining in the liquid receptacle based on a detection signal from the detection unit. In the case where the control unit has determined that greater than or equal to a specified value of the liquid in the liquid receptacle has been consumed without the liquid receptacle and the detection unit arriving at the predetermined positional relationship, the control unit performs forced detection control that sets the liquid receptacle and the detection unit to the predetermined positional relationship and causes the detection unit to detect the remaining state of the liquid.

10 Claims, 15 Drawing Sheets

FIG. 12

| | POSITION | DETECTED VOLTAGE |
|---|---|---|
| IC1(C) | P11 | VD11 |
| | P12 | VD12 |
| | P13 | VD13 |
| | ⋮ | ⋮ |
| IC2(M) | P21 | VD21 |
| | P22 | VD22 |
| | P23 | VD23 |
| | ⋮ | ⋮ |
| IC3(Y) | P31 | VD31 |
| | P32 | VD32 |
| | P33 | VD33 |
| | ⋮ | ⋮ |
| IC4(K) | P41 | VD41 |
| | P42 | VD42 |
| | P43 | VD43 |
| | ⋮ | ⋮ |

LIQUID CONSUMING APPARATUS AND CONTROL METHOD FOR LIQUID CONSUMING APPARATUS

CROSS REFERENCE TO RELATED APPLICATION

The entire disclosure of Japanese Patent Application No. 2012-124298, filed May 31, 2012 is expressly incorporated by reference herein.

BACKGROUND

1. Technical Field

The present invention relates to liquid consuming apparatuses and to control methods for liquid consuming apparatuses.

2. Related Art

Ink cartridges, which are removable liquid receptacles, are mounted in ink jet printing apparatuses, which are examples of liquid consuming apparatuses. The ink cartridges are each provided with an optical path member (a prism) for detecting an amount of ink when the amount of ink within the ink cartridge has dropped below a predetermined amount in some case.

For example, in the past art disclosed in JP-A-5-332812, an optical path member having a refractive index near that of ink is provided in an ink cartridge. When ink is full on the inner side of the optical path member, light from a light-emitting unit passes into the ink from the optical path member. On the other hand, in the case where the ink is empty on the inner side of the optical path member, the light emitted from the light-emitting unit is fully reflected at an inner surface of the optical path member, and the fully-reflected light is then detected by a light-receiving unit. Through this, the remaining state of the ink can be detected.

However, when printing a printing pattern in which the ink cartridge does not pass through the position of a detection unit (that is, a sensor position), the remaining state of the ink cannot be detected by the detection unit. Accordingly, there is a risk of blank printing on the paper or the like if the printing pattern continues to be printed.

SUMMARY

It is an advantage of some aspects of the invention to provide a liquid consuming apparatus capable of eliminating, for example, a situation in which the state of a remaining liquid cannot be detected due to a liquid receptacle and a detection unit not being in a predetermined positional relationship, a control method for such a liquid consuming apparatus, and so on.

An aspect of the invention relates to a liquid consuming apparatus including a liquid receptacle that holds a liquid, a head that discharges the liquid supplied from the liquid receptacle, a driving unit that performs driving that moves the head, a detection unit that detects a remaining state of the liquid in the liquid receptacle, and a control unit that controls the driving unit and that, in the case where the liquid receptacle and the detection unit are in a predetermined positional relationship, determines whether or not there is liquid remaining in the liquid receptacle based on a detection signal from the detection unit; here, in the case where the control unit has determined that greater than or equal to a specified value of the liquid in the liquid receptacle has been consumed without the liquid receptacle and the detection unit arriving at the predetermined positional relationship, the control unit performs forced detection control that sets the liquid receptacle and the detection unit to the predetermined positional relationship and causes the detection unit to detect the remaining state of the liquid.

According to this aspect of the invention, in the case where the liquid receptacle and the detection unit are in the predetermined positional relationship, whether or not there is liquid remaining in the liquid receptacle is determined based on the detection signal from the detection unit. Then, when it is determined that greater than or equal to the specified value of the liquid has been consumed without the liquid receptacle and the detection unit arriving at the predetermined positional relationship, the forced detection control that sets the liquid receptacle and the detection unit to the predetermined positional relationship and causes the detection unit to detect the remaining state of the liquid is executed. By performing the forced detection control in this manner, the liquid receptacle and the detection unit are set to the predetermined positional relationship and the detection unit detects the remaining state of the liquid, even a case such as where a state in which the liquid receptacle and the detection unit do not arrive at the predetermined positional relationship continues due to a liquid discharge pattern or the like. Accordingly, it is possible to eliminate a situation in which the remaining state of the liquid cannot be detected due to the liquid receptacle and the detection unit not being in the predetermined positional relationship.

According to another aspect of the invention, it is preferable that the control unit determine whether or not the liquid receptacle and the detection unit are in the predetermined positional relationship with each printing pass of the head, and in the case where it has been determined that greater than or equal to the specified value of the liquid in the liquid receptacle has been consumed without the liquid receptacle and the detection unit arriving at the predetermined positional relationship, the forced detection control be performed in the next printing pass of the head.

By determining whether or not the liquid receptacle and the detection unit are in the predetermined positional relationship with each printing pass of the head in this manner, it is possible to detect the remaining state of the liquid at short intervals, which in turn makes it possible to accurately detect the remaining state. Then, in the case where it has been determined that greater than or equal to the specified value of the liquid has been consumed without the liquid receptacle and the detection unit arriving at the predetermined positional relationship, the forced detection control is carried out in the next pass, making it possible to correctly detect the remaining state of the liquid in the next pass.

According to another aspect of the invention, it is preferable that the liquid consuming apparatus further include a storage unit that stores liquid amount information of the liquid receptacle; here, in the case where the liquid receptacle and the detection unit arrive at the predetermined positional relationship in an ith printing pass of the head (where i is a natural number) and the detection unit detects that there is liquid remaining in the liquid receptacle, the storage unit store the liquid amount information of the liquid receptacle as ith liquid amount information; in the case where the liquid receptacle and the detection unit do not arrive at the predetermined positional relationship in a jth pass that follows the ith pass (where j is a natural number greater than i) and the amount of liquid consumed from the ith liquid amount information in the ith pass is less than the specified value, the control unit do not perform the forced detection control in a j+1th pass that follows the jth pass; and in the case where the liquid receptacle and the detection unit do not arrive at the predetermined positional relationship in a kth pass that follows the jth pass (where k is a natural number greater than j) and the amount of liquid consumed from the ith liquid amount information in the ith pass is greater than or equal to the specified value, the control unit perform the forced detection control in the k+1th pass that follows the kth pass.

According to this aspect, when it is determined in the kth pass that the amount of liquid consumed is greater than or equal to the specified value from the liquid amount information of the liquid receptacle in the ith pass in which the remaining state of the liquid was detected, the forced detection control is carried out in the following k+1th pass, which makes it possible for the detection unit to correctly detect the remaining state of the liquid.

According to another aspect of the invention, in the case where the remaining amount of liquid in the liquid receptacle is greater than or equal to a second specified value, it is preferable that the control unit omit the forced detection control processing and move to the processing of the next pass.

According to this aspect, the processing can be made more efficient and the liquid consuming apparatus operations and processing can be made more efficient by omitting the forced detection control processing in the case where the remaining amount of the liquid in the liquid receptacle is greater than or equal to the second specified value.

According to another aspect of the invention, it is preferable that the control unit determine whether or not the liquid receptacle and the detection unit are in the predetermined positional relationship based on whether or not the detection signal from the detection unit indicating the remaining state of the liquid has been measured, and in the case where it has been determined that greater than or equal to the specified value of the liquid in the liquid receptacle has been consumed without the detection signal being measured, the control unit perform the forced detection control.

By determining whether or not the liquid receptacle and the detection unit are in the predetermined positional relationship based on whether or not the detection signal from the detection unit has been measured in this manner, the forced detection control performed in the case where the specified value of the liquid has been consumed following the detection of the remaining state of the liquid can be executed correctly and with certainty.

According to another aspect of the invention, it is preferable that the liquid consuming apparatus further include a plurality of types of liquid receptacles provided as the liquid receptacle, and the control unit perform the forced detection control in the case where it has been determined that greater than or equal to the specified value of the liquid has been consumed without the detection signal indicating the remaining state of the liquid being measured for at least one of the plurality of types of liquid receptacles.

When it is determined that greater than or equal to the specified value of the liquid has been consumed without the detection signal being measured for at least one of the plurality of types of liquid receptacles, the forced detection control is performed. Accordingly, it is possible to effectively suppress a situation where a liquid receptacle, in which a problem such as the liquid being consumed without the remaining state being detected occurs, is present.

According to another aspect of the invention, it is preferable that, in the case where the detection signal has been measured, the control unit determine whether or not there is liquid remaining in the liquid receptacle based on the measured detection signal, and in the case where it has been determined that there is no liquid remaining, the control unit make a provisional near end determination for the liquid and perform the forced detection control, and the control unit make a final near end determination for the liquid in the case where the provisional near end determination has been made for the liquid greater than or equal to a specified number of times in a row.

In this manner, the final near end determination is made for the first time after the provisional near end determination has been made greater than or equal to a specified number of times, which makes it possible to improve the reliability of the processing.

According to another aspect of the invention, it is preferable that the control unit determine whether or not greater than or equal to the specified value of the liquid in the liquid receptacle has been consumed by estimating the amount of liquid consumed based on a dot count value of the liquid discharged from the head.

By doing so, whether or not greater than or equal to the specified value of the liquid has been consumed can be determined through a process for estimating the amount of liquid consumed based on a dot count value of the liquid that has been discharged.

According to another aspect of the invention, it is preferable that the liquid receptacle be mounted in a carriage that includes the head, the driving unit perform driving that moves the carriage in which the head and the liquid receptacle are mounted, and the control unit perform, as the forced detection control, control that causes the driving unit to move the carriage so that the liquid receptacle mounted in the carriage and the detection unit arrive at the predetermined positional relationship.

By doing so, the detection of the remaining state, the forced detection control, and so on can be correctly executed in a configuration in which the liquid receptacle and the head are mounted in the carriage.

According to another aspect of the invention, it is preferable that the control unit control the driving unit so that the liquid receptacle and the detection unit arrive at the predetermined positional relationship during a period in which the carriage is moving at a constant velocity.

By doing so, it is possible to prevent a situation in which the remaining state of the liquid is detected when, for example, the surface of the liquid is unstable.

According to another aspect of the invention, it is preferable that the detection unit be mounted in a carriage that includes the head, the driving unit perform driving that moves the carriage in which the head and the detection unit are mounted, and the control unit perform, as the forced detection control, control that causes the driving unit to move the carriage so that the detection unit mounted in the carriage and the liquid receptacle arrive at the predetermined positional relationship.

By doing so, the detection of the remaining state, the forced detection control, and so on can be correctly executed in a configuration in which the detection unit and the head are mounted in the carriage.

According to another aspect of the invention, it is preferable that the detection unit include a light-emitting unit and a light-receiving unit, the liquid receptacle include a prism that reflects light emitted from the light-emitting unit of the detection unit in accordance with the remaining state of the liquid, and the control unit detect the remaining state of the liquid in the liquid receptacle based on the detection signal that is obtained by the light-receiving unit of the detection unit receiving the light reflected by the prism.

In this manner, a prism is provided in the liquid receptacle, and the remaining state of the liquid can be correctly detected based on the detection signal that is obtained by receiving the light reflected by the prism.

Another aspect of the invention relates to a control method for a liquid consuming apparatus, the method including determining, in the case where a liquid receptacle that holds a liquid and a detection unit that detects the remaining state of the liquid in the liquid receptacle are in a predetermined positional relationship, whether or not there is liquid remaining in the liquid receptacle based on a detection signal from the detection unit, determining whether or not greater than or equal to a specified value of the liquid in the liquid receptacle has been consumed without the liquid receptacle and the detection unit arriving at the predetermined positional relationship, and in the case where it has been determined that greater than or equal to the specified value of the liquid in the liquid receptacle has been consumed, performing forced detection control that sets the liquid receptacle and the detection unit to the predetermined positional relationship by controlling a driving unit that moves a head, and causes the detection unit to detect the remaining state of the liquid.

According to another aspect of the invention, when it is determined that greater than or equal to the specified value of the liquid has been consumed without the liquid receptacle and the detection unit arriving at the predetermined positional relationship, the forced detection control that sets the liquid receptacle and the detection unit to the predetermined positional relationship and causes the detection unit to detect the remaining state of the liquid is executed. By performing the forced detection control in this manner, the liquid receptacle and the detection unit are set to the predetermined positional relationship and the detection unit detects the remaining state of the liquid, even a case such as where a state in which the liquid receptacle and the detection unit do not arrive at the predetermined positional relationship continues due to a liquid discharge pattern or the like; this in turn makes it possible to correctly detect the remaining state of the liquid.

BRIEF DESCRIPTION OF THE DRAWINGS

The invention will be described with reference to the accompanying drawings, wherein like numbers reference like elements.

FIG. 12 is a descriptive diagram illustrating detected voltages.

DESCRIPTION OF EXEMPLARY EMBODIMENTS

Hereinafter, a preferred embodiment of the invention will be described in detail. Note that the embodiment described hereinafter is not intended to limit the content as described in the appended aspects of the invention in any way, and not all of the configurations described in this embodiment are required as the means to solve the problems as described above.

For example, although the following describes an ink cartridge that holds ink and a printing apparatus that discharges ink as examples, the embodiment is not limited thereto and can be applied in liquid receptacles that hold various liquids and liquid consuming apparatuses that discharge (eject) those liquids. The liquids may be any liquids that can be discharged by the liquid consuming apparatus, and include solutions, solvents, sols, gels, as well as suspensions/mixtures that contain matters, minute particles, or the like in such solutions, solvents, sols, or gels.

1. Printing Apparatus, Ink Cartridge

Figure 1:
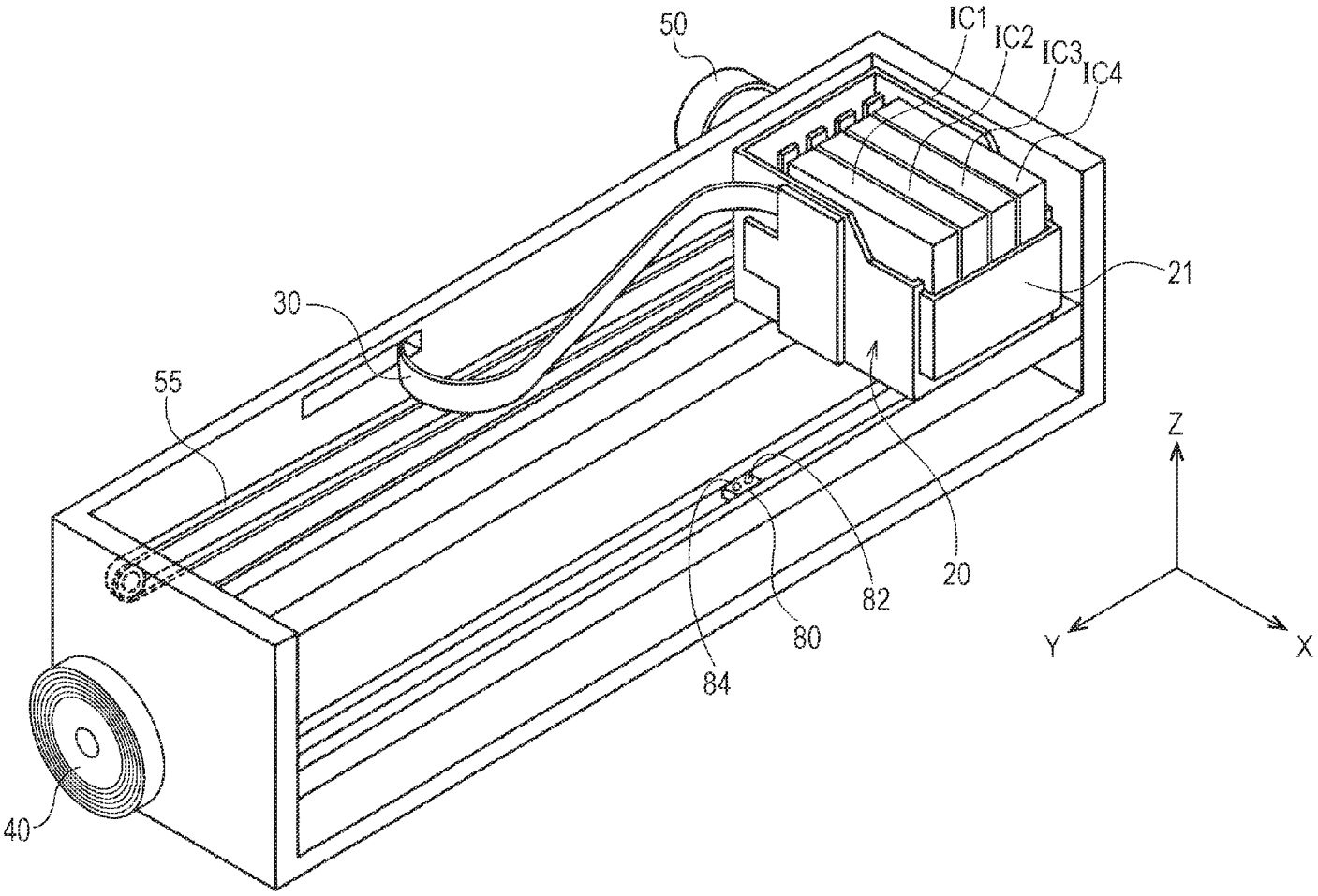
FIG. 1 is a perspective view illustrating the primary components of a printing apparatus according to an embodiment.

FIG. 1 is a perspective view illustrating the primary components of a printing apparatus (a liquid consuming apparatus) according to the embodiment. The printing apparatus illustrated in FIG. 1 includes ink cartridges IC1 to IC4 (liquid receptacles), a carriage 20 having a holder 21 that holds the ink cartridges IC1 to IC4 in a removable state and a head, a cable 30, a paper feed motor 40, a carriage motor (and more broadly defined, a driving unit) 50, a carriage driving belt 55, and a detection unit 80.

One color of ink (liquid, printing material) is held in the each of the ink cartridges IC1 to IC4. The ink cartridges IC1 to IC4 are mounted in the holder 21 in a removable state. The inks supplied from the ink cartridges IC1 to IC4 are discharged from the head (a head 22, described later and illustrated in FIG. 7) toward a paper surface. The carriage 20 is connected to a control unit (a control unit 100, described later and illustrated in FIG. 7) by the cable 30, and discharge control is carried out by the control unit via this cable 30. The paper feed motor 40 rotationally drives a paper feed roller (a paper feed roller 45, described later and illustrated in FIG. 7), and feeds a printing medium (printing paper or the like) in the X direction shown in FIG. 1. The carriage motor 50 causes the carriage 20 to move along the Y direction by driving the carriage driving belt 55. Printing operations are carried out by the control unit controlling the discharge, paper feeding, movement of the carriage 20, and so on. Note that the Y direction in which the carriage 20 is moved is referred to as a "main scanning direction", whereas the X direction in which the printing medium is fed is referred to as a "sub scanning direction".

The detection unit 80 detects a state of the ink remaining in the ink cartridges IC1 to IC4. Specifically, the detection unit 80 includes a light-emitting unit (light-emitting element) 82 that emits light toward prisms (a prism 320 in FIG. 2) provided in the ink cartridges IC1 to IC4 and a light-receiving unit (light-receiving element) 84 that receives light reflected from the prism and converts the received light into an electrical signal. For example, the light-emitting unit 82 is configured of an LED (light emission diode), and the light-receiving unit 84 is configured of a phototransistor.

Figure 2:
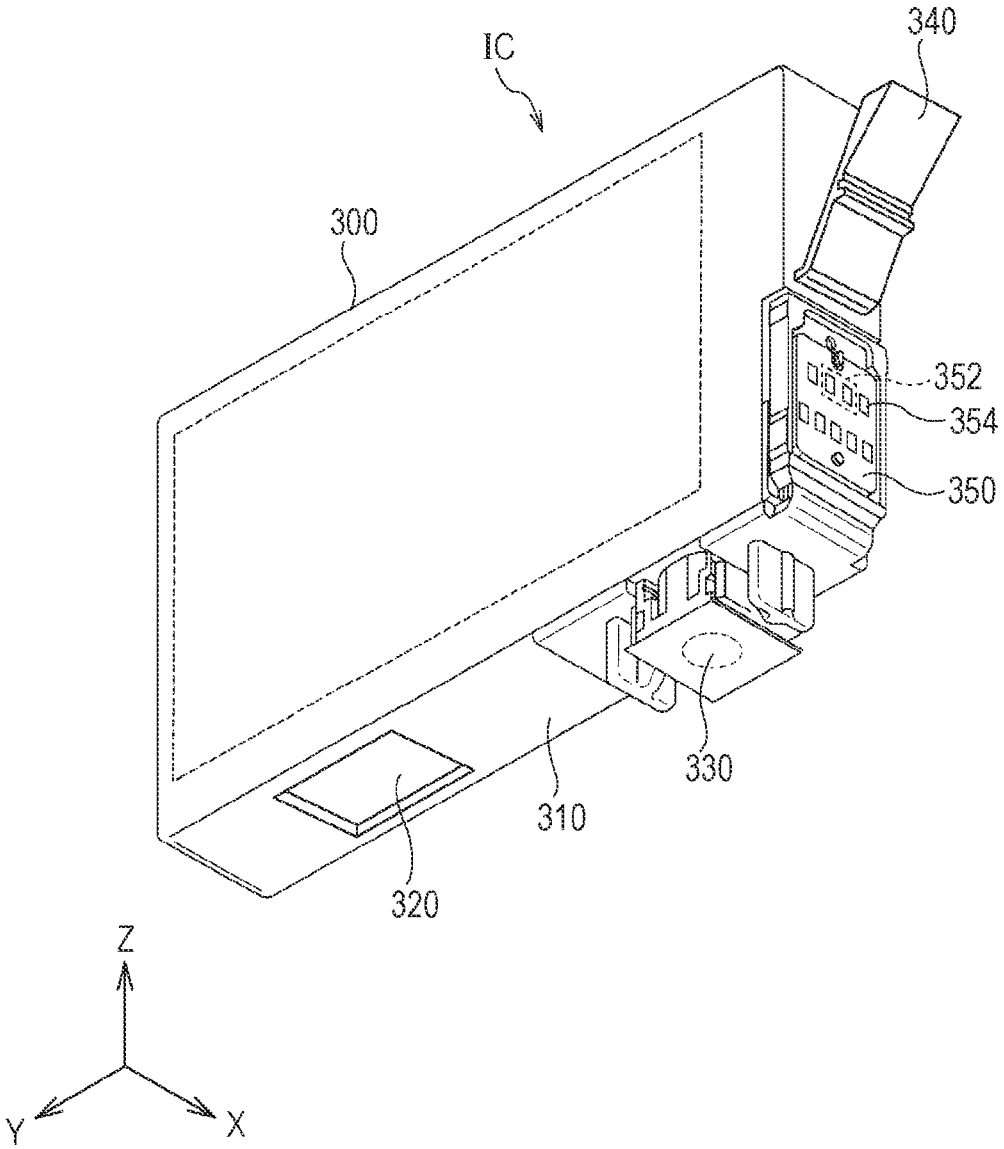
FIG. 2 is a perspective view illustrating the primary components of an ink cartridge.

FIG. 2 is a perspective view illustrating the primary components of the ink cartridges IC1 to IC4. An ink cartridge IC shown in FIG. 2 corresponds to each of the ink cartridges IC1 to IC4 shown in FIG. 1.

The ink cartridge IC includes an ink holding portion 300 having a rectangular parallelepiped shape (this also includes approximately rectangular parallelepiped shapes) that holds ink, a board 350 (a circuit board), a lever 340 for removing/mounting the ink cartridge IC from/on the holder 21, an ink supply opening 330 that supplies ink to the head, and the prism 320 provided in a base surface 310 of the ink cartridge IC. A storage device 352 that stores information regarding the ink cartridge IC is mounted to the rear surface of the board 350. A plurality of terminals 354 that are electrically connected to the storage device 352 are disposed on the surface of the board 350. The plurality of terminals 354 are electrically connected to a corresponding plurality of main body terminals provided in the holder 21 when the ink cartridge IC is mounted in the holder 21. For example, a non-volatile memory such as an EEPROM can be used as the storage device 352.

The prism 320 is configured of a member that is transparent with respect to light from the light-emitting unit 82, and is configured of, for example, polypropylene. The prism 320 is provided so that a plane of incidence on which light from the light-emitting unit 82 is incident is exposed on the base surface 310 of the ink cartridge IC. The base surface 310 is a surface that faces in a −Z direction when the ink cartridge IC is mounted in the holder 21 shown in FIG. 1, and an opening for allowing the light from the light-emitting unit 82 to be incident on the plane of incidence of the prism 320 is provided in the holder 21. In other words, when the carriage 20 moves in the main scanning direction (the Y direction) shown in FIG. 1, the ink cartridges IC1 to IC4 sequentially move in a +Y direction or a −Y direction above the detection unit 80, and the light reflected from the prism 320 of each ink cartridge is then received by the light-receiving unit 84. In this embodiment, the remaining state of the ink in each of the ink cartridges is detected based on a detection signal from the light-receiving unit 84 (a light-receiving result signal). Specifically, whether or not the ink is near the end is detected.

Here, the ink being "near the end" refers to a state in which the remaining amount of ink held in the ink holding portion 300, a liquid surface level, or the like is below a predetermined value and there is only a small amount of ink remaining in the ink cartridge IC.

2. Method for Detecting Remaining State of Ink

A method for detecting the remaining state of the ink (that is, whether or not the ink is near the end) will be described using FIGS. 3, 4, and 5.

Figure 3:
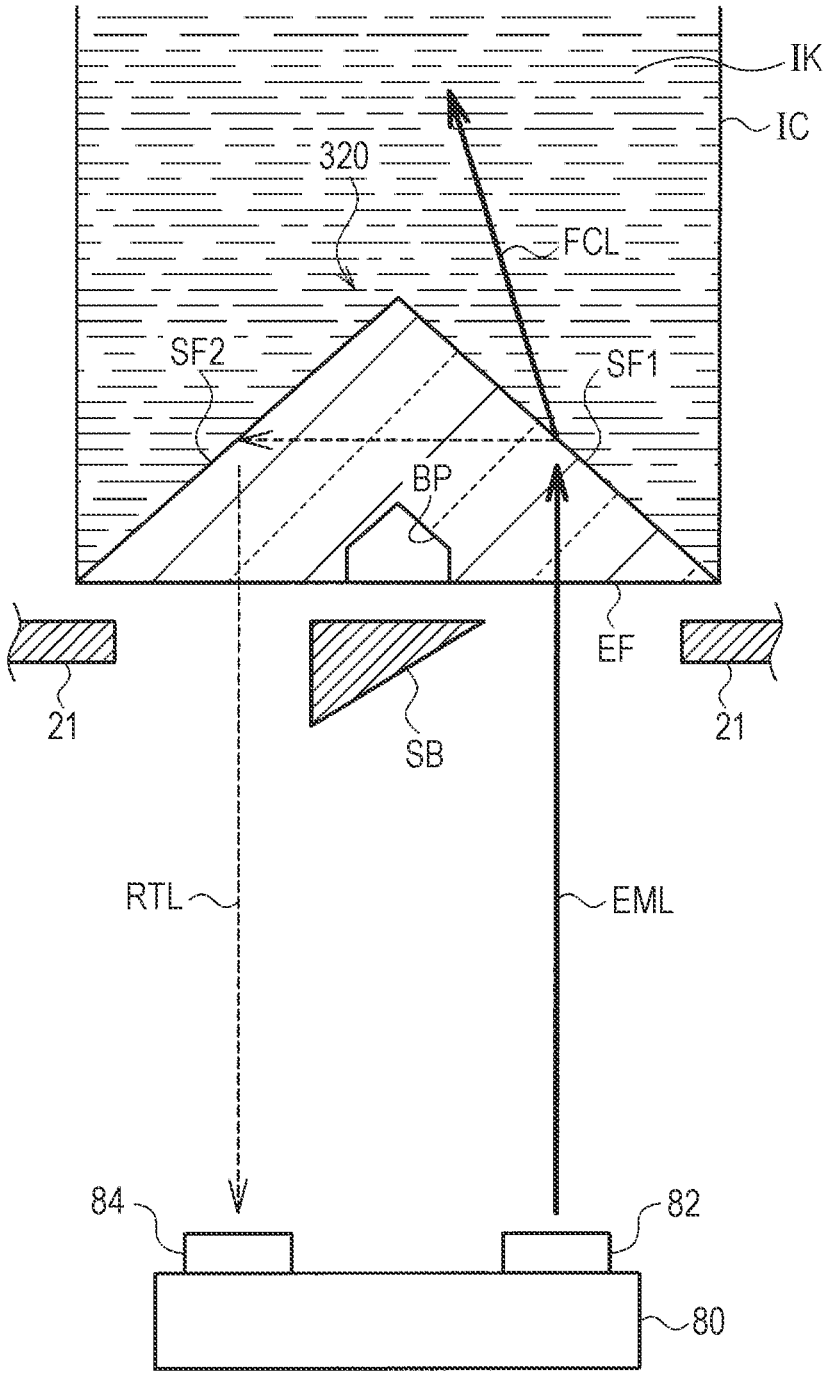
FIG. 3 is a descriptive diagram illustrating the reflection of light by a prism in the case where a sufficient amount of ink remains in an ink chamber.
Figure 4:
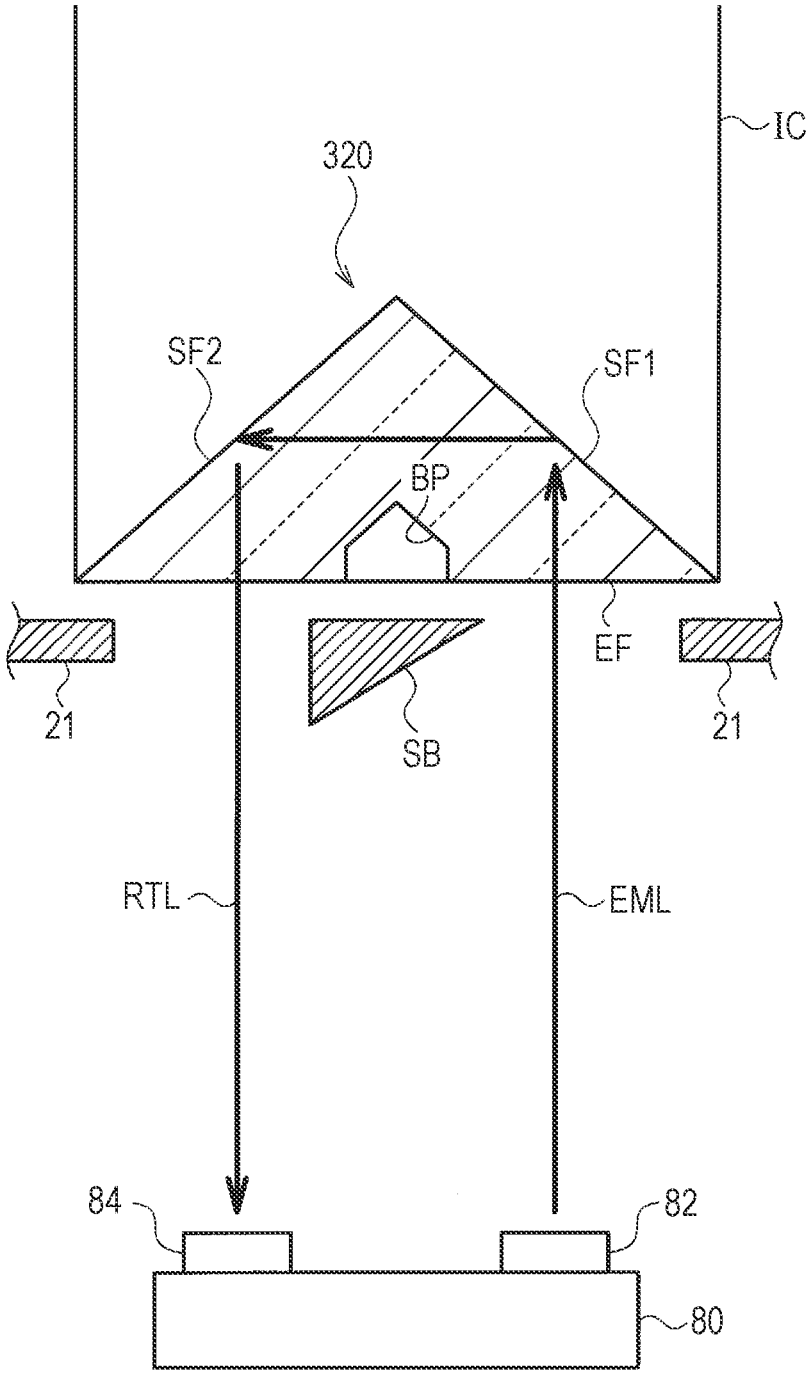
FIG. 4 is a descriptive diagram illustrating the reflection of light by a prism in the case where there is no ink in an ink chamber.

FIGS. 3 and 4 are diagrams illustrating a cross-section of the prism taken along the YZ plane shown in FIG. 1 and a positional relationship between the prism 320 and the detection unit 80 at a detection position. As shown in FIG. 3, a cavity portion BP is provided in a plane of incidence EF in order to suppress deformations occurring when the prism 320 is formed. An opening is provided in the holder 21, and the configuration is such that the plane of incidence EF and the detection unit 80 face each other through the opening when the ink cartridge IC is mounted in the holder 21. Slanted faces SF1 and SF2 of the prism 320 face inward in the ink holding portion 300, and ink IK makes contact with the slanted faces SF1 and SF2 in the case where the ink holding portion 300 is filled with the ink IK. The slanted face SF1 is, for example, a face that is orthogonal to the slanted face SF2, and the slanted face SF1 and the slanted face SF2 are faces disposed so as to be symmetrical relative to the XZ plane shown in FIG. 1.

As shown in FIG. 3, in the case where the ink cartridge IC is filled with the ink IK, light EML incident on the prism 320 from the light-emitting unit 82 enters into the ink IK from the slanted face SF1 (light FCL). In this case, there is an extremely small amount of light RTL reflected by the slanted faces SF1 and SF2, and thus the light-receiving unit 84 receives almost no light. For example, assuming that the refractive index of the ink is essentially the same as the refractive index of water, or 1.5, in the case where the prism 320 is configured of polypropylene, the critical angle for full reflection at the slanted faces SF1 and SF2 is approximately 64°. However, because the angle of incidence is 45°, the slanted faces SF1 and SF2 do not achieve full reflection, and thus the incident light EML enters into the ink IK.

As shown in FIG. 4, in the case where the ink cartridge IC is not filled with the ink IK (that is, is empty) and the surfaces of the slanted faces SF1 and SF2 of the prism 320 that are irradiated with light from the light-emitting unit 82 make contact with the air as a result, the light EML incident on the prism 320 from the light-emitting unit 82 is fully reflected by the slanted faces SF1 and SF2 and passes once again to the outside of the prism 320 from the plane of incidence EF (the light RTL). In this case, the light-receiving unit 84 receives the fully-reflected light RTL, and thus a strong detection signal is obtained. For example, assuming that the refractive index of the air is 1, in the case where the prism 320 is configured of polypropylene, the critical angle for full reflection at the slanted faces SF1 and SF2 is approximately 43°. Because the angle of incidence is 45°, the slanted faces SF1 and SF2 fully reflect the incident light EML.

Figure 5:
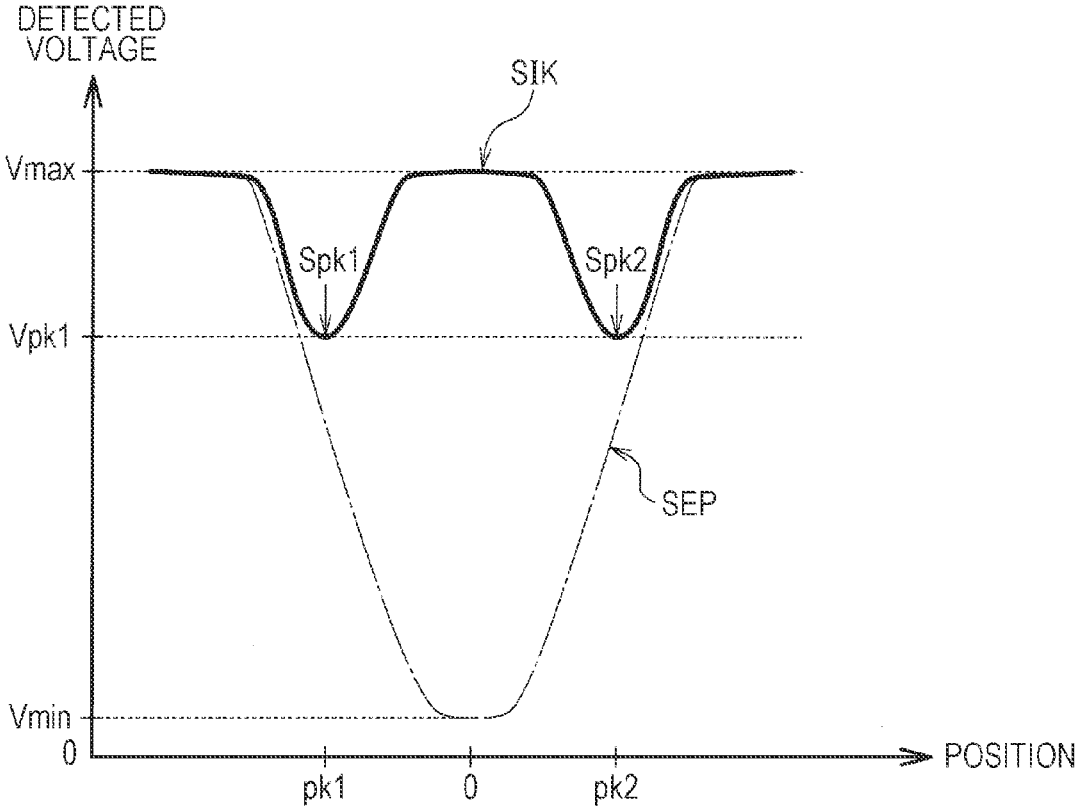
FIG. 5 is a descriptive diagram illustrating voltages detected by a detection unit.

FIG. 5 illustrates an example of the properties of a detected voltage (detection signal) of the detection unit 80. The horizontal axis in FIG. 5 represents a relative position between the prism 320 and the detection unit 80. The vertical axis represents a detected voltage outputted from the detection unit 80 at each position on the horizontal axis. In FIG. 5, the closer to 0 the amount of light received by the light-receiving unit 84 is, the closer to a maximum voltage Vmax the detected voltage becomes; likewise, the greater the amount of light received by the light-receiving unit 84 is, the closer to a minimum voltage Vmin the detected voltage becomes. When the amount of received light exceeds a predetermined value, the detected voltage is saturated and drops to the minimum voltage Vmin.

As shown in FIG. 5, the detected voltage of the detection unit 80 changes in accordance with the relative position between the detection unit 80 and the prism 320. Furthermore, as indicated by SIK in FIG. 5, the amount of light received by the light-receiving unit 84 is low in the case where the ink cartridge IC is filled with the ink IK as shown in FIG. 3, and thus the detected voltage approaches Vmax at a position "0". Here, the position "0" is a position (detection position) where the center of the prism 320 and the center of the detection unit 80 in the main scanning direction match. The "center of the detection unit 80" is the center of the light-emitting unit 82 and the light-receiving unit 84 in the main scanning direction. At positions pk1 and pk2, in which the relative positions of the center of the prism 320 and the center of the detection unit 80 are shifted from the position "0" in the main scanning direction, peaks Spk1 and Spk2 are produced by the reflected light from the prism plane of incidence EF.

As indicated by SEP, the amount of light received by the light-receiving unit 84 is high in the case where the ink cartridge IC is not filled with the ink IK as shown in FIG. 4, and thus the detected voltage reaches (or approaches) Vmin at the position "0". In this manner, the properties of the detected voltage change significantly depending on whether or not the ink cartridge IC is filled with the ink IK, and thus in this embodiment, the state of the ink remaining in the ink cartridge is detected by detecting differences in the properties of the detected voltage.

Specifically, based on a peak voltage Vpk1 at SIK, a threshold is set between the peak voltage Vpk1 and the minimum voltage Vmin. Then, in the case where the detected voltage exceeds the threshold when the ink cartridge IC passes above the detection unit 80 (a +Z direction in FIG. 1) (that is, in the case of SIK), it is determined that ink remains. On the other hand, in the case where the detected voltage does not exceed the threshold (that is, in the case of SEP), it is determined that the ink is near the end (empty).

3. Example of Detailed Configuration of Printing Apparatus

It was discovered that the following problem is present in the case where a printing pattern (discharge pattern) is printed onto a printing medium by a printing apparatus having the detection unit 80 as in this embodiment. The detection unit 80 is provided within a range in which the carriage 20 moves in order to print a printing pattern that is provided across all rows in the ±Y direction of paper that can be printed onto by the printing apparatus. In the case where the ink cartridge IC does not pass through the detection position of the detection unit 80 due to the size of the paper to be printed onto, the printing pattern, or the like, the detection of the remaining state is not executed by the detection unit 80, and there is the risk of blank printing if such a printing pattern continues to be printed.

Figure 6A:
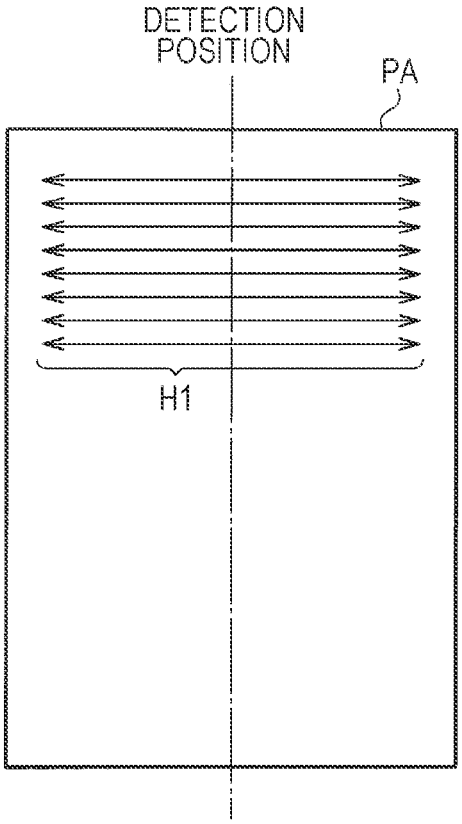
FIGS. 6A and 6B are descriptive diagrams illustrating problems occurring depending on a printing pattern.

FIG. 6A is an example of a case in which the printing pattern is present in a range indicated by H1. The printing pattern indicates a printing range for the printing of a printing target such as text, images, or the like onto a printing medium PA, and matches the range of movement of the carriage 20 during printing. With the printing pattern illustrated in FIG. 6A, the detection position of the detection unit 80 is essentially in the center of the printing pattern, and the ink cartridge IC of the carriage 20 passes through the detection position during printing; accordingly, detection of the remaining state using the detection unit 80 as illustrated in FIGS. 3 to 5 can be executed in each printing pass resulting from the movement of the printing head 22 (the movement of the head 22 in the +Y direction or the −Y direction during printing is taken as a single pass; in the case of printing during movement in both directions, a single round-trip is taken as two passes). Accordingly, the remaining state of the ink can be checked at fine intervals, which makes it possible to reduce the risk of blank printing. In other words, the amount of ink consumed in each pass of the printing is sufficiently low relative to the amount of ink consumed when printing onto the entire printing medium PA is carried out. Accordingly, even if the ink being near the end (empty) cannot be detected during a given pass, the ink being near the end can be detected in the next pass, which makes it possible to reduce the risk of blank printing.

Figure 6B:
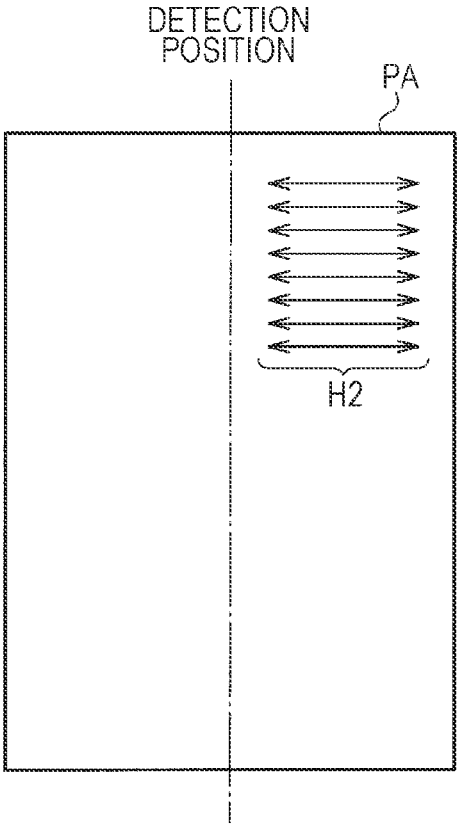

Meanwhile, FIG. 6B is an example of a case in which the printing pattern is present in a range indicated by H2, and here, the printing pattern is present only in the right half of the printing medium PA. With a printing pattern such as that shown in FIG. 6B, the ink cartridge IC does not pass through the detection position, and thus the remaining state of the ink cannot be detected in each pass of the printing. In other words, when detecting the remaining state, it is necessary for the light from the light-emitting unit 82 of the detection unit 80 shown in FIG. 1 to be incident on the prism 320 of the ink cartridge IC shown in FIG. 2. However, with a printing pattern such as that shown in FIG. 6B, the ink cartridge IC that is mounted in the carriage 20 along with the head 22 and that moves along therewith does not pass above the detection unit 80 in each pass of the printing. Accordingly, the light from the light-emitting unit 82 of the detection unit 80 is not incident on the prism 320 of the ink cartridge IC, and thus the detection of the remaining state of the ink as shown in FIGS. 3 to 5 cannot be executed during each pass of the printing. If a printing pattern such as that shown in FIG. 6B continues to be printed, the ink will be consumed without the remaining state of the ink being detected, and there is thus a risk that a situation such as blank printing will arise.

Figure 7:
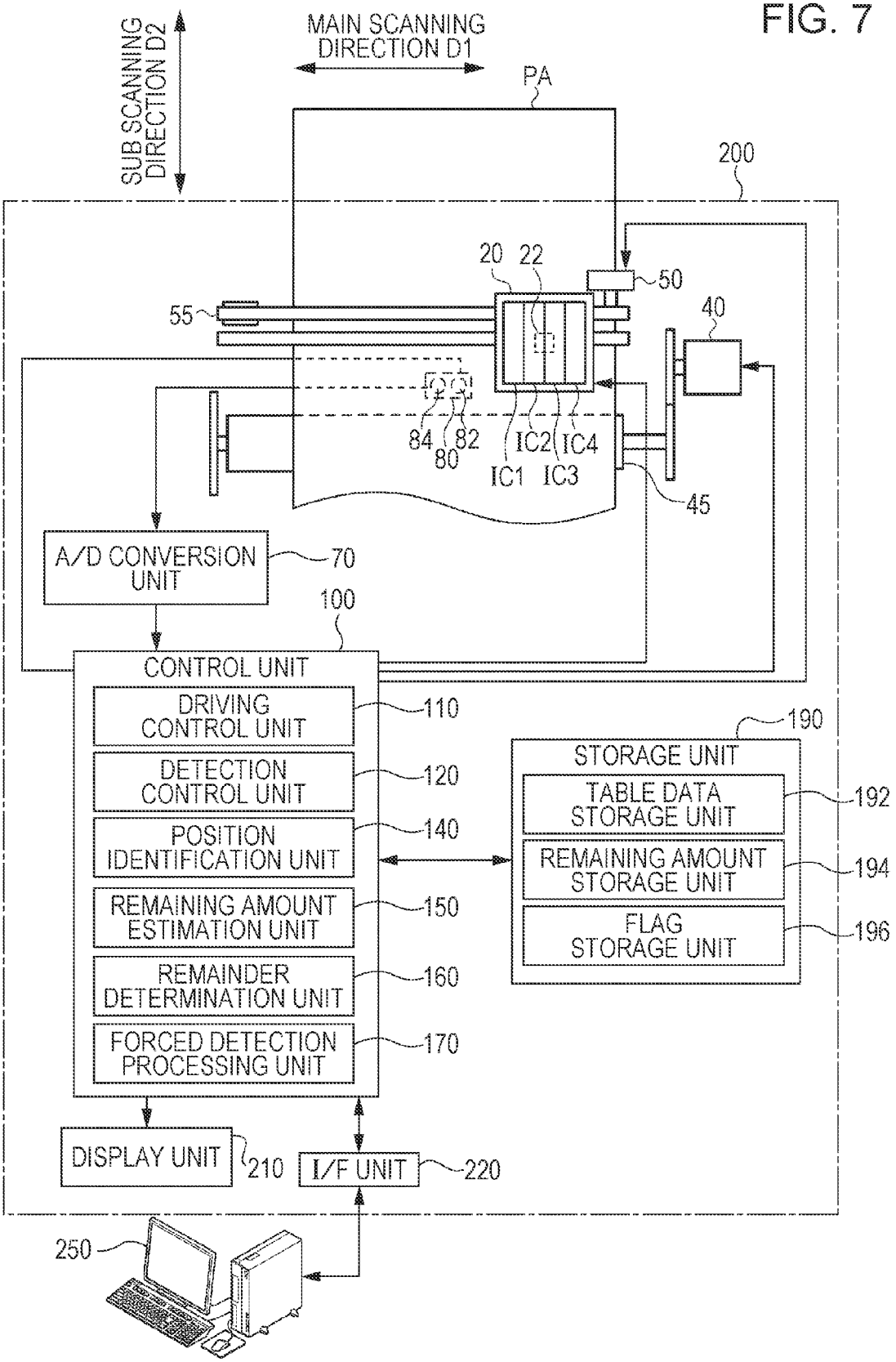
FIG. 7 illustrates an example of the configuration of a printing apparatus according to the embodiment.

FIG. 7 illustrates an example of the detailed configuration of a printing apparatus 200 according to this embodiment that solves the aforementioned problem. In FIG. 7, the main scanning direction is indicated by D1, and the sub scanning direction is indicated by D2.

The printing apparatus 200 shown in FIG. 7 includes: the ink cartridges IC1 to IC4; the carriage 20; the paper feed motor 40 for the printing medium PA; the paper feed roller 45; the carriage motor 50; the carriage driving belt 55; an A/D conversion unit 70; the detection unit 80; the control unit 100; a storage unit 190; a display unit 210; and an interface (I/F) unit 220. It should be noted that the printing apparatus 200 according to this embodiment is not limited to the configuration illustrated in FIG. 7; many variations thereupon are possible, such as omitting some of the constituent elements, adding other constituent elements, and so on. Furthermore, constituent elements that are the same as constituent elements illustrated in FIG. 1 are assigned the same reference numerals, and descriptions thereof are omitted as appropriate.

The control unit 100 includes a driving control unit 110, a detection control unit 120, a position identification unit 140, a remaining amount estimation unit 150, a remainder determination unit 160, and a forced detection processing unit 170. The control unit 100 is realized by a processor such as a CPU, a program operated by the processor, and so on. For example, the processes of the respective units in the control unit 100 are executed by a program stored in a ROM being loaded into the storage unit 190 and being executed by the processor. Note that the control unit 100 can also be realized by a dedicated ASIC.

The driving control unit 110 controls the driving unit of the printing apparatus 200. Specifically, the carriage motor 50, which corresponds to the driving unit, is controlled. For example, control for moving the carriage 20 is performed by controlling the carriage motor 50 based on movement control table data stored in a table data storage unit 192 of the storage unit 190. Through this, driving that moves the holder 21 and the head 22 provided in the carriage 20 is carried out by the carriage motor 50.

The detection control unit 120 performs various types of control of the detection unit 80. For example, the detection control unit 120 controls the light-emitting unit 82 of the detection unit 80, controls the light-receiving unit 84 of the detection unit 80, and so on. For example, the detection control unit 120 performs a process for determining the amount of light emitted by the light-emitting unit 82 based on the detection signal from the detection unit 80 and the like. The detection control unit 120 then generates a PWM signal based on the determined amount of emitted light, and controls the amount of light emitted by the light-emitting unit 82. Alternatively, the detection control unit 120 performs a process for determining a threshold when the ink is near the end, performed based on a light-receiving result obtained by the light-receiving unit 84.

The position identification unit 140 performs a process for identifying the position of the carriage 20 (the holder 21) in the main scanning direction D1. For example, the position of the head 22, for example, is identified as the position of the carriage 20, and the positional relationship between the head 22 and the ink cartridges IC1 to IC4 (called simply the "ink cartridges IC" hereinafter as appropriate) is known as a result; accordingly, the positions of the respective ink cartridges in the main scanning direction D1 can also be identified. More specifically, the carriage motor 50 is provided with a rotary encoder; the position identification unit 140 identifies the amount by which the carriage 20 has moved based on a signal (a pulse signal) from the rotary encoder, and the position of the carriage 20 in each pass of the printing is identified.

The remaining amount estimation unit 150 performs a process for estimating the remaining amount of ink (ink amount information or liquid amount information). For example, the amount of ink that has been consumed is estimated based on a dot count value of the discharged ink from the head 22 that has been used in the printing. Specifically, the number of ink droplets ejected from the head 22 is counted, and the amount of ink that has been consumed (a usage amount) is calculated by multiplying the number of counted ink droplets by the mass of a single ink droplet. This usage amount includes the amount of ink consumed for printing and the amount of ink consumed for cleaning the head. The remaining amount of ink is then estimated by subtracting the calculated consumed amount from an initial fill amount of each ink cartridge. While printing is being executed, the remaining amount of ink is updated and stored in the storage unit 190 in each pass of the printing. The remaining amount of ink estimated in this manner is written and stored in the storage device 352 for each of the ink cartridges IC shown in FIG. 2. Then, when the printing apparatus 200 is started up, the remaining amount of ink is read out and obtained from the storage devices 352 of the ink cartridges IC, and is stored in a remaining amount storage unit 194 in the storage unit 190 (RAM). While the printing apparatus 200 is on, the remaining amount of ink in the remaining amount storage unit 194 is updated in accordance with the execution of printing, cleaning of the head 22, and so on. Then, when the printing apparatus 200 is turned off, when the ink cartridges IC are replaced, or each time a predetermined amount of ink has been consumed, the updated estimated remaining amount of ink is written back into the storage devices 352 of the ink cartridges IC. Although the following describes a case in which the ink amount information is the remaining amount of ink, it should be noted that the ink amount information may be the ink consumption amount. Meanwhile, the remaining amount of ink, the ink consumption amount, and so on may be stored as weight data of the ink, or may be stored as data indicating a percentage of the fill amount of the ink in the ink cartridge IC prior to the start of use.

The remainder determination unit 160 performs a process for determining the remaining state of the ink in the ink cartridges. For example, the remainder determination unit 160 performs a process for determining whether or not there is ink remaining in the respective ink cartridges (that is, a process for determining whether or not the ink is near the end) based on the detection signal (detected voltage) from the detection unit 80. Specifically, the A/D conversion unit 70 performs A/D conversion on the detected voltage, which is the detection signal from the detection unit 80, and inputs the resulting signal to the control unit 100 as a digital signal. The remainder determination unit 160 of the control unit 100 then performs a process for comparing the detected voltage with a threshold based on the detected voltage converted into the digital signal, and performs a process for determining the remaining state of the ink. Then, for ink cartridges for which it has been determined that no ink remains (that is, ink cartridges for which it has been determined that the ink is near the end), the user is prompted to replace the ink cartridge by an alarm communicating the need to replace the ink being displayed in the display unit 210 or in a display unit of a PC (personal computer) 250 connected via the I/F unit 220.

The forced detection processing unit 170 performs various processes for forced detection control according to this embodiment. Details of forced detection processing will be given later.

The storage unit 190 is realized by, for example, a RAM or the like, and includes the table data storage unit 192, the remaining amount storage unit 194, and a flag storage unit 196. The table data storage unit 192 stores table data for the carriage motor 50 to control the movement of the carriage 20. The remaining amount storage unit 194 stores the remaining amount of ink that is estimated by the remaining amount estimation unit 150 and is sequentially updated. The flag storage unit 196 stores information in various types of flags, such as a forced control flag, which will be described later.

In the embodiment described above, and as shown in FIG. 7, the printing apparatus includes the ink cartridges that hold ink, the head 22 that discharges the ink supplied from the ink cartridges, the carriage motor 50 that performs driving for moving the head 22, the detection unit 80 that detects the remaining state of the ink in the ink cartridges, and the control unit 100. Then, the control unit 100 controls the carriage motor 50, and in the case where the ink cartridge and the detection unit 80 are in a predetermined positional relationship (a positional relationship in which the detection unit 80 can detect the remaining state of the ink in the ink cartridge; also called the "detection position"), the control unit 100 determines whether or not there is ink remaining in the ink cartridge based on the detection signal from the detection unit 80.

In this embodiment, in the case where it has been determined that greater than or equal to a specified value (a predetermined threshold) of the ink in the ink cartridge has been consumed without the ink cartridge and the detection unit 80 arriving at the predetermined positional relationship, the control unit 100 performs forced detection control, in which the ink cartridge and the detection unit 80 are set to the predetermined positional relationship and the detection unit 80 is caused to detect the remaining state of the ink. Specifically, the control unit 100 determines whether or not the ink cartridge and the detection unit 80 are in the predetermined positional relationship with each printing pass made by the head 22. In the case where it has been determined that greater than or equal to the specified value of ink has been consumed without the ink cartridge and the detection unit 80 arriving at the predetermined positional relationship, the forced detection control is carried out in the next printing pass made by the head 22.

Figure 8:
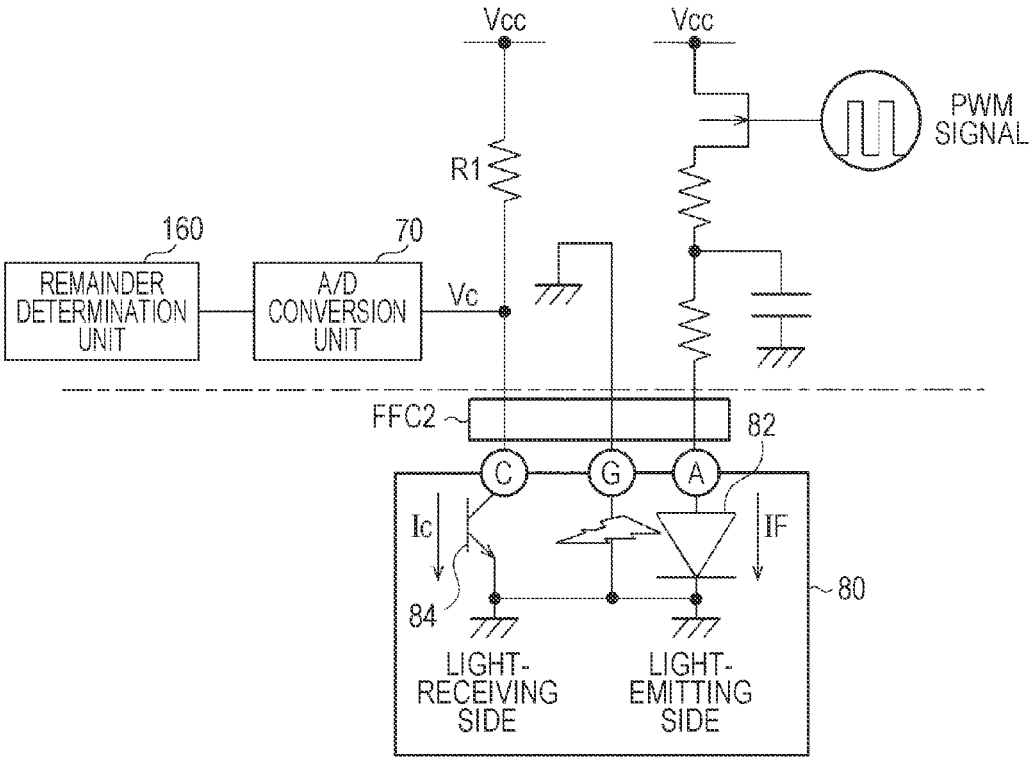
FIG. 8 illustrates an example of the configuration of a detection unit.

FIG. 8 illustrates a specific example of the configuration of the detection unit 80. Note that the configuration of the detection unit 80 is not limited to that shown in FIG. 8, and a variety of variations can be made thereon.

The detection unit 80 includes the light-emitting unit 82 and the light-receiving unit 84. The light-emitting unit 82 emits light, whereas the light-receiving unit 84 receives light. The detection unit 80 is configured of a reflective-type photointerrupter. The detection unit 80 causes an LED to emit light while adjusting the duty ratio (the ratio of on time to off time) of a PWM (pulse width modulation) signal. The light emitted from the LED is incident upon the phototransistor after being reflected by the prism 320 within the ink cartridge IC, and is then converted into a current value. The current value is converted into a voltage Vc by a resistor R1, the voltage Vc experiences A/D conversion by the A/D conversion unit 70, and a digital signal obtained from the A/D conversion is inputted into the remainder determination unit 160 of the control unit 100.

In this manner, in this embodiment, the detection unit 80 includes the light-emitting unit 82 and the light-receiving unit 84, and the ink cartridge includes the prism 320 that reflects the light emitted from the light-emitting unit 82 of the detection unit 80 in accordance with the remaining state of the ink. The control unit 100 detects the remaining state of the ink in the ink cartridge based on the detection signal (the post-A/D conversion detected voltage) obtained by the light-receiving unit 84 of the detection unit 80 receiving the reflected light from the prism 320.

4. Method According to this Embodiment 4.1 Forced Detection Control

Next, a method according to this embodiment will be described in detail. As described earlier with reference to FIGS. 6A and 6B, the printing apparatus that includes the detection unit 80 cannot correctly detect the remaining state using the detection unit 80 when executing a print job for a printing pattern in which the ink cartridge does not pass through the detection position of the detection unit 80. In other words, with a printing pattern such as that shown in FIG. 6B, the ink cartridge does not pass through the detection position, and the remaining state of the ink cannot be detected in each printing pass; there is thus a risk of blank printing and so on.

To solve this problem, in this embodiment, when the printing pattern is a pattern such as that shown in FIG. 6B, a method is employed in which the detection unit 80 is forced to detect the remaining state of the ink by performing the forced detection control.

For example, in this embodiment, it is determined whether or not there is ink remaining in the ink cartridge based on the detection signal from the detection unit 80 in the case where the ink cartridge and the detection unit 80 are in the predetermined positional relationship. This determination is carried out by the remainder determination unit 160 shown in FIG. 7. Here, the "predetermined positional relationship" is a positional relationship in which the remaining state of the ink can be detected by the detection unit 80. To use FIG. 1 is an example, the predetermined positional relationship is a positional relationship in which the ink cartridge mounted in the carriage 20 that includes the head 22 passes through the position of the detection unit 80, and when such a positional relationship occurs, the remaining state of the ink can be detected by the detection unit 80.

In this embodiment, it is determined whether or not greater than or equal to the specified value of the ink has been consumed without the ink cartridges IC1 to IC4 and the detection unit 80 arriving at the stated predetermined positional relationship (that is, a positional relationship in which the detection can be carried out).

Figures 9A, 9B, 9C:
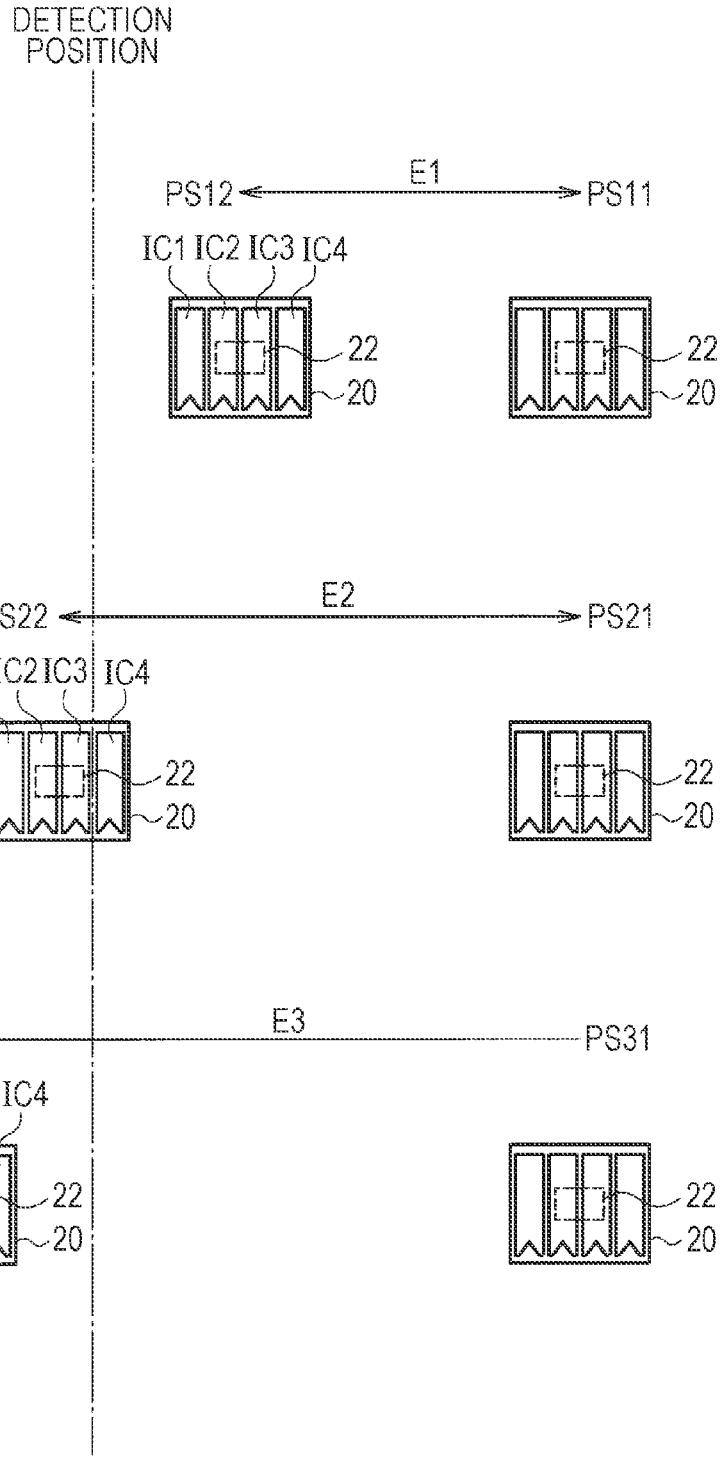
FIGS. 9A through 9C are descriptive diagrams illustrating a forced detection control method according to the embodiment.

Specifically, E1 in FIG. 9A indicates the range of movement of the carriage 20. The carriage 20 moves from a position PS11, reverses at a position PS12, and returns to the position PS11; the remainder determination unit 160 determines that the ink cartridges IC1 to IC4 mounted in the carriage 20 including the head 22 have not arrived at the positional relationship of passing through the detection position, which is the position of the detection unit 80.

Meanwhile, FIG. 9B illustrates a case in which the range of movement of the carriage 20 corresponds to the range indicated by E2. The carriage 20 moves from a position PS21 and reverses at a position PS22 that is past the detection position, but in this case as well, it is determined that the stated predetermined positional relationship has not been arrived at. In other words, even if the ink cartridges IC1 to IC3 have passed through the detection position, it is determined that the stated predetermined positional relationship has not been arrived at if the ink cartridge IC4 has not passed through the detection position. This is because although it is possible to determine the remaining state of the ink for the ink cartridges IC1 to IC3, it is not possible to determine the remaining state for the ink cartridge IC4.

In this embodiment, in the case where greater than or equal to the specified value of the ink has been consumed without such a positional relationship being arrived at, the control unit 100 causes the ink cartridges IC1 to IC4 to move in a range indicated by E3 as shown in FIG. 9C, regardless of the printing pattern. In other words, the forced detection control, in which the ink cartridges IC1 to IC4 and the detection unit 80 are set to the predetermined positional relationship and the detection unit 80 is caused to detect the remaining state of the ink, is carried out. In other words, with the forced detection control for E3 in FIG. 9C, the carriage 20 moves from a position PS31 to a position PS32 that is past the detection position. In this case, with the forced detection control for E3 in FIG. 9C, the carriage 20 moves to the position PS32, and thus all of the ink cartridges IC1 to IC4 pass through the detection position. As a result, the remaining state of the ink can be detected for all of the ink cartridges IC1 to IC4, and thus the occurrence of blank printing or the like can be suppressed.

Furthermore, in this embodiment, the control unit 100 determines whether or not the ink cartridges and the detection unit 80 are in the predetermined positional relationship (that is, a positional relationship in which the detection can be performed) with each printing pass of the head 22 (that is, every 1 pass). For example, it is determined whether or not the ink cartridges mounted in the carriage 20 have passed through the detection position of the detection unit 80 with each printing pass. In the case where it has been determined that greater than or equal to the specified value of ink has been consumed without the ink cartridges and the detection unit 80 arriving at the predetermined positional relationship (that is, without arriving at a positional relationship in which the detection can be carried out), the forced detection control is carried out in the next printing pass made by the head 22. For example, when it is determined that greater than or equal to the specified value of the ink has been consumed without the ink cartridges passing through the detection position in the present pass, as indicated in FIGS. 9A and 9B, the forced detection control as indicated by E3 in FIG. 9C is performed in the next pass. In other words, the carriage 20 is moved by controlling the driving of the carriage motor 50 so that the ink cartridges pass through the detection position and reverse at the position PS32. More specifically, during a pass in which PS31 serves as a starting position, PS32 serves as the position of the end of the pass; during a pass in which PS12 or PS22 serves as a starting position, the starting position of the pass is changed to PS32.

The storage unit 190 (remaining amount storage unit 194) shown in FIG. 7 stores the remaining amount of ink in the ink cartridge found by the remaining amount estimation unit 150 (that is, the liquid amount information) for each printing pass.

Figure 10:
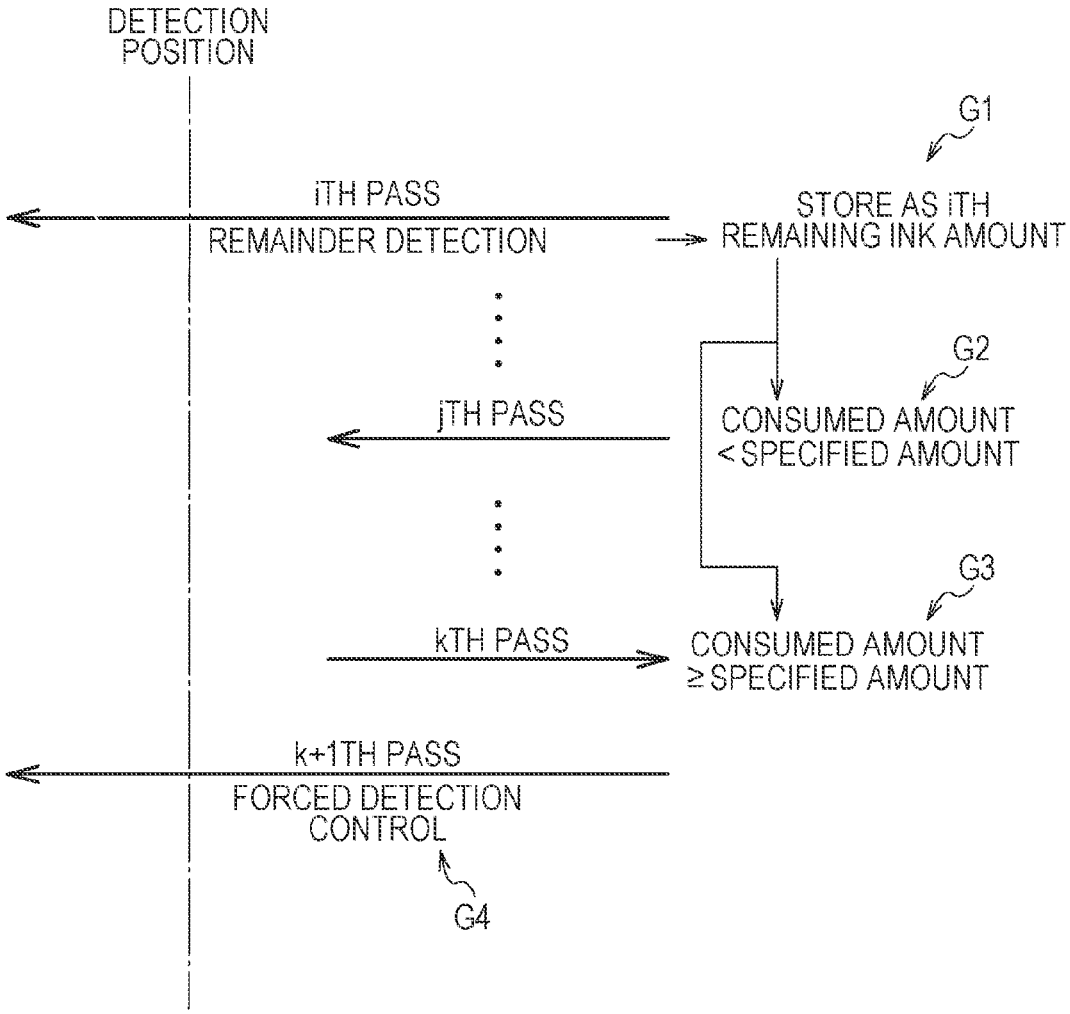
FIG. 10 is a descriptive diagram illustrating a forced detection control method according to the embodiment.

Meanwhile, as indicated by G1 in FIG. 10, in the case where the ink cartridge and the detection unit 80 have arrived at the predetermined positional relationship and remaining ink has been detected by the detection unit 80 in an ith pass (where i is a natural number) of the movement of the head 22, the storage unit 190 stores the remaining amount of ink at that time in association with the pass as an ith remaining amount of ink, as a result of the ink being detected as being present. In other words, the remaining amount of ink that is detected the last time there is remaining ink is stored as the ith remaining amount of ink.

Then, as indicated by, for example, G2 in FIG. 10, it is assumed that in a jth pass (where j is a natural number greater than i) that follows the ith pass, the ink cartridge and the detection unit 80 do not arrive at the predetermined positional relationship and the amount of ink consumed from the ith remaining amount of ink in the ith pass (that is, ith liquid amount information) is less than the specified value. In this case, the control unit 100 does not perform the forced detection control in a j+1th pass, which follows the jth pass. In other words, the processing is moved to the next pass without performing the forced detection control.

On the other hand, as indicated by G3 in FIG. 10, it is assumed that in a kth pass (where k is a natural number greater than j) that follows the jth pass, the ink cartridge and the detection unit 80 do not arrive at the predetermined positional relationship, and the amount of ink consumed from the ith remaining amount of ink is greater than or equal to the specified value. In other words, it is assumed that the amount of ink consumed from the time at which a remainder was last detected for the ink is greater than or equal to the specified value. In this case, as indicated by G4, the control unit 100 carries out the forced detection control in a k+1th pass that follows the kth pass. In other words, as shown in FIG. 9C, control is carried out for moving the carriage 20 so that the carriage 20 reverses at the position PS32, where all of the ink cartridges IC1 to 1C4 pass through the detection position. By doing so, when the amount of ink consumed from the ith remaining amount of ink reaches the specified value in the kth pass, the remaining ink can be detected with certainty in the next pass, which is the k+1th pass. Accordingly, it is possible to suppress a situation in which the printing is continued without the remaining ink being detected and blank printing is performed as a result.

Note that in the case where the amount of ink remaining in the ink cartridge is greater than or equal to a second specified value, the control unit 100 may omit the forced detection control processing (that is, the process of determining whether or not to perform the forced detection control), and may move to the processing of the next pass. Here, the second specified value is a value of the remaining amount of ink estimated by the remaining amount estimation unit 150 having taken into consideration the tolerances, usage environments, and so on of the printing apparatus and the ink cartridges, in which the remaining amount of ink estimated by the remaining amount estimation unit 150 is not detected as being near the end of the ink by the detection unit 80. For example, in the case where the remaining amount of ink is greater than or equal to the second specified value and there is a sufficient amount of remaining ink, the processing moves to the next pass without performing a process for determining whether or not the amount of consumed ink from the ith remaining amount of ink is greater than or equal to the specified value. By doing so, it is possible, in the case where there is a sufficient remaining amount of ink, to suppress the forced detection processing from being wastefully performed and causing a situation such as where the printing speed drops.

According to the method of this embodiment as described above, in the case where the remaining state of the ink is detected (that is, whether the ink is near the end is detected) during printing, the remaining state of the ink can be detected before a set amount of ink (the specified value) is consumed following the previous detection of the remaining state of the ink, regardless of the printing pattern. Specifically, as indicated by G1 in FIG. 10, the remaining amount of ink calculated by the remaining amount estimation unit 150 is stored when remaining ink has been detected (that is, when ink is present). Then, as indicated by G2 and G3, the forced detection processing unit 170 determines whether or not the amount of ink consumed (used) thereafter has exceeded the specified value using the count value calculated by the remaining amount estimation unit 150. By performing the forced detection control as indicated by G4 prior to the ink within the ink cartridge dropping below a usage limit and blank printing occurring as a result, the detection of the remaining state of the ink is performed. Through this, even in the case where a printing pattern such as that shown in FIG. 6B is printed, the risk of blank printing can be reduced.

In addition, according to this embodiment, it is determined whether or not the ink cartridge and the detection unit 80 are in a positional relationship in which the remaining state of the ink can be detected with each printing pass. Whether or not such a positional relationship has been arrived at is determined based on, for example, whether or not a detection signal for the remaining state of the ink from the detection unit 80 has been correctly measured, as will be described later. By performing this determination with each printing pass in this manner, it is possible to detect the remaining state of the ink in short intervals from when the ink is full to when the ink reaches the end, which in turn makes it possible to accurately detect the remaining state of the ink.

A method that detects the remaining state of the ink each time, for example, one page's worth of printing is complete can be considered as a comparative example. However, this method cannot determine whether the ink is near the end at the start of a single page or whether the ink is near the end at the end of a single page. Accordingly, to prevent blank printing, it is necessary to determine whether the ink is near the end even in the case where the ink is near the end at the start of a page, and as a result, it is necessary to increase the amount of ink required to be left after the final detection of the remaining state of the ink beyond what is actually necessary.

With respect to this point, in this embodiment, the remaining state of the ink is detected with each printing pass, and thus the amount of ink that is required to be left after the final detection of the remaining state of the ink (that is, the specified value) can be reduced.

Figure 11A:
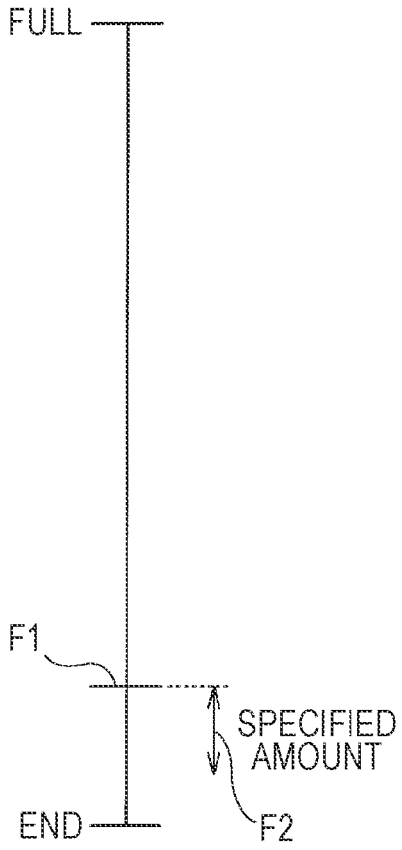
FIGS. 11A through 11D are descriptive diagrams illustrating specified values.
Figure 11B:
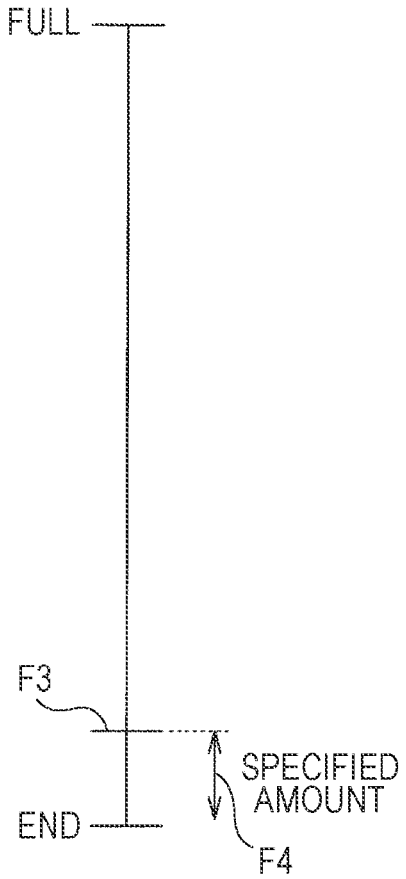
Figure 11C:
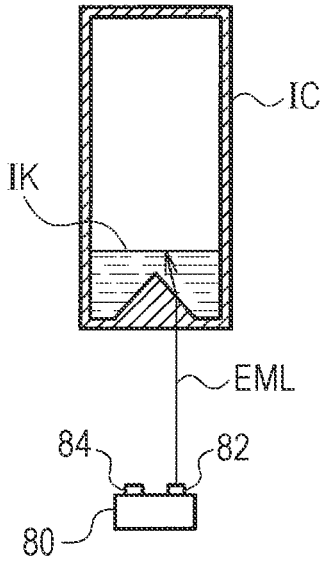
Figure 11D:
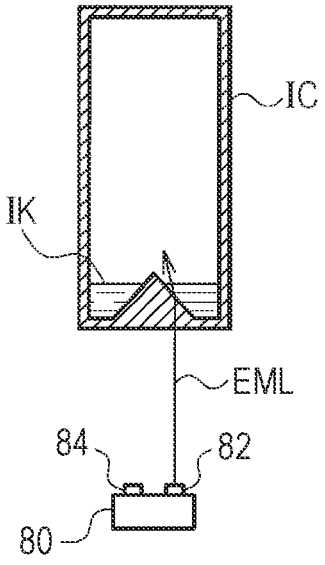

FIGS. 11A to 11D are descriptive diagrams illustrating the specified value. F1 in FIG. 11A indicates a case in which a comparatively high amount of ink remained in the ink cartridge IC when the previous detection of the remaining state of ink was carried out, as indicated in FIG. 11C. In other words, this corresponds to a case in which the liquid surface of the ink is located significantly higher than a border between a region where it is determined that ink remains and a region where it is determined that no ink remains. Even if the specified value of ink is consumed from the state indicated by F1 without the remaining state of the ink being detected, as indicated by F2, there is still ink left before the ink reaches the end.

On the other hand, F3 in FIG. 11B indicates a case in which the liquid surface of the ink is located immediately above the border between the region where it was determined that ink remains and the region where it was determined that no ink remains when the remaining state of the ink was previously detected. In this embodiment, the specified value is set so that the ink does not reach the end in the case where the ink is consumed from the state indicated by F3 in FIG. 11B without the remaining state of the ink being detected, as indicated by F4. By doing so, when it is determined that an amount of ink corresponding to the specified value indicated by F4 has been consumed, the forced detection control is carried out, which makes it possible to effectively suppress a situation in which the ink reaches the end and blank printing is carried out.

4.2 Positional Relationship Determination

Next, an example of a method for determining a positional relationship in which detection can be carried out will be described. In this embodiment, the control unit 100 determines whether or not the ink cartridge and the detection unit 80 are in the aforementioned predetermined positional relationship based on whether or not a detection signal from the detection unit 80 indicating the remaining state of the ink has been measured. In the case where it has been determined that greater than or equal to the specified value of the ink has been consumed without the detection signal being measured, the aforementioned forced detection control is carried out.

For example, in this embodiment, the detected voltages (the post-A/D conversion detected voltages) that correspond to the detection signals from the detection unit 80 are associated with positions of the respective ink cartridges (that is, relative positions between the detection unit 80 and the prisms 320) and are loaded into the storage unit 190 (RAM). For example, in FIG. 12, P11, P12, P13, and so on and VD11, VD12, and VD13 indicate respective positions of a cyan (C) ink cartridge IC1 and the detected voltages at each of those positions. P21, P22, P23, and so on and VD21, VD22, and VD23 indicate respective positions of a magenta (M) ink cartridge IC2 and the detected voltages at each of those positions. The same applies to yellow (Y) and black (K) ink cartridges IC3 and IC4.

For example, a waveform of the detected voltage of the detection unit 80 is as indicated in the aforementioned FIG. 5. The respective positions in the waveform shown in FIG. 5 and the detected voltages at each of those positions are obtained as data having a data structure such as that shown in FIG. 12, and the data is loaded into the storage unit 190. Note that the position of the carriage 20 (the holder 21) in which the ink cartridges IC1 to IC4 are mounted is, as mentioned earlier, identified based on a signal (a pulse signal) from the rotary encoder provided for the carriage motor 50. Because the relative positions between the carriage 20 and respective ink cartridges IC1 to IC4 are known, the positions P11, P12, P13, and so on, and the positions P21, P22, P23, and so on shown in FIG. 12 can be identified based on the position of the carriage 20.

In this embodiment, whether or not the ink cartridges IC1 to IC4 and the detection unit 80 are in the predetermined positional relationship (a positional relationship in which detection can be carried out) is determined based on whether or not data of the detected voltages shown in FIG. 12 has been measured.

For example, with E1 in FIG. 9A, the ink cartridges IC1 to IC4 have not passed through the detection position. Accordingly, the data of the detected voltages as indicated in FIG. 5 are not measured for all of the ink cartridges IC1 to IC4, and thus it is determined that the ink cartridges IC1 to IC4 and the detection unit 80 are not in the predetermined positional relationship. In the case where greater than or equal to the specified value of the ink is consumed with such a state continuing, the forced detection control illustrated in FIG. 9C is carried out. When the forced detection control is carried out, the data of the detected voltages indicated in FIG. 5 is measured for all of the ink cartridges IC1 to IC4, and the remaining state of the ink is detected.

Meanwhile, in FIG. 9B, the ink cartridges IC1 to IC3 pass through the detection position, but the ink cartridge IC4 does not pass through the detection position. Accordingly, although the data of the detected voltages indicated in FIG. 5 is measured for the ink cartridges IC1 to IC3, the data of the detected voltages is not measured for the ink cartridge IC4. In other words, the data of the detected voltages for the ink cartridge IC4 is not loaded into the storage unit 190. Even in such a case, in this embodiment, the forced detection control is carried out when greater than or equal to the specified value of the ink is consumed, the data of the detected voltages is measured for all of the ink cartridges IC1 to IC4, and the remaining state of the ink is detected. By doing so, even in the case where the printing of a printing pattern such as that shown in FIG. 6B is carried out using only the color of the ink cartridge IC4 (K), a situation in which the ink reaches the end due to the printing of that printing pattern and blank printing is carried out can be suppressed.

For example, a method in which whether or not the ink cartridges have passed through the detection position is determined based on position information specified by a signal from a rotary encoder can be considered. However, the information that is actually necessary is a determination as to whether or not the ink cartridges have passed through the detection position and the remaining state of the ink has been detected with certainty; accordingly, with a method based on position information, uncertainty regarding such a determination remains.

With respect to this point, the method that determines whether or not each ink cartridge has passed through the detection position (that is, whether or not the predetermined positional relationship has been arrived at) based on whether or not the data of the detected voltages has been measured, makes it possible to ensure with certainty that the ink cartridges have passed through the detection position and the remaining state detection of the ink is carried out. Accordingly, the forced detection control performed in the case where the specified value of the ink has been consumed after the remaining state of the ink has been detected can be executed correctly and with certainty.

Note that in this embodiment, the control unit 100 determines whether or not there is ink remaining in the ink cartridge based on a measured detected voltage in the case where the detected voltage has been measured. Then, a provisional near end determination may be performed in the case where it has been determined in a given printing pass that no ink remains, and the forced detection control that sets a return position of the carriage 20 (that is, an ending position of a pass or a starting position of a pass) so that the carriage 20 passes above the detection unit 80 with certainty may be carried out in the next printing pass. A final near end determination is then made in the case where the provisional near end determination has been made greater than or equal to a specified number of times in a row. In other words, in the case where it has been determined that no ink remains based on the measured detected voltage from the detection unit 80, a final near end determination is not immediately carried out; instead, the final near end determination is carried out under the condition that the provisional near end determination has been carried out greater than or equal to a specified number of times in a row. By doing so, a final near end determination is not made in the case where a determination of the ink that is near the end has been mistakenly made for some reason; instead, the final near end determination is first made after the stated determination has been made greater than or equal to a specified number of times in a row. This makes it possible to determine the remaining state of the ink in a stable manner.

4.3 Carriage Movement Control

FIG. 7 illustrates an on-carriage configuration, in which the holder 21 in which the ink cartridges IC1 to IC4 are mounted is provided on the carriage 20. In this case, the carriage motor 50 (and more broadly defined as the driving unit) performs driving for moving the carriage 20 that is provided with the holder 21 in which the ink cartridges IC1 to IC4 are mounted and the head 22. When the forced detection control is executed, the control unit 100 performs control for causing the carriage motor 50 (the driving unit) to move the carriage 20 so that the ink cartridges IC1 to IC4 mounted in the holder 21 of the carriage 20 and the detection unit 80 arrive at a positional relationship in which the detection can be carried out. Specifically, movement control is carried out so that the movement of the carriage 20 starts at the position PS31 shown in FIG. 9C and the carriage 20 reverses at the position PS32.

However, when the carriage 20 passes through the detection position as a result of this forced detection control, the surface of the ink within the ink cartridge will shift due to movement of the carriage 20, and there is thus a risk that the ink being near the end (that is, the remaining state of the ink) cannot be accurately detected.

Figure 13A:
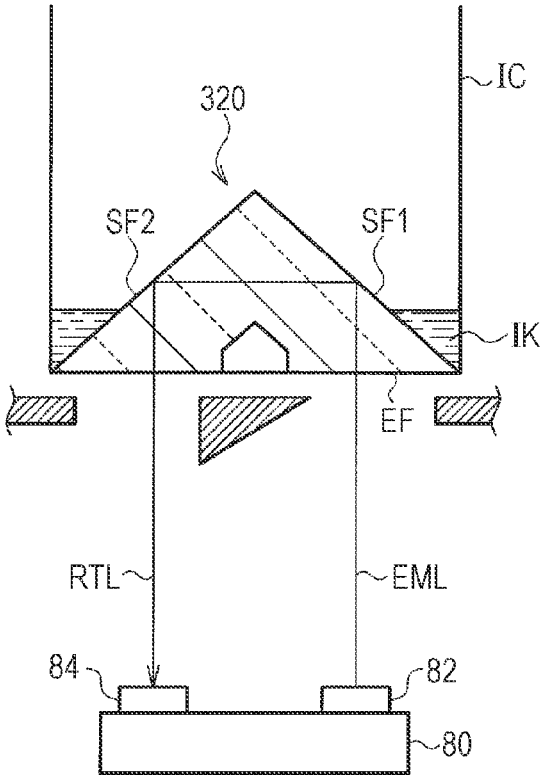
FIGS. 13A and 13B are descriptive diagrams illustrating shifting of a liquid surface due to movement of a carriage.

For example, in FIG. 13A, the surface of the ink IK is not shifting, and thus the light EML incident on the prism 320 from the light-emitting unit 82 is fully reflected by the slanted faces SF1 and SF2 of the prism 320, the reflected light RTL is received by the light-receiving unit 84, and the ink being near the end is correctly detected.

Figure 13B:
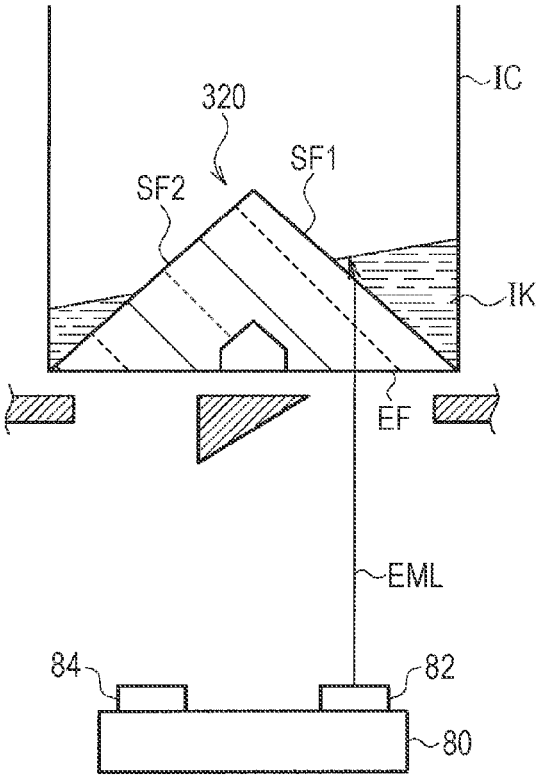

FIG. 13B illustrates a state in which the same amount of ink as shown in FIG. 13A remains in the ink cartridge but the surface of the ink IK has shifted due to movement of the carriage 20. In this case, the light EML from the light-emitting unit 82 enters into the ink without being fully reflected by the slanted face SF1, and the reflected light cannot be received by the light-receiving unit 84 as a result; accordingly, the ink being near the end cannot be detected.

Accordingly, in this embodiment, the position at which the carriage 20 returns is controlled during the forced detection control so that the carriage 20 passes through the detection position while the surface of the ink is in a stable state. Specifically, during the forced detection control, the control unit 100 controls the carriage motor 50 so that the ink cartridges and the detection unit 80 are in a positional relationship in which the detection can be carried out during a constant velocity movement period of the carriage. In other words, during forced detection control, control is carried out so that the carriage 20 passes through the detection position at a constant velocity (or at a constant acceleration).

Figure 14:
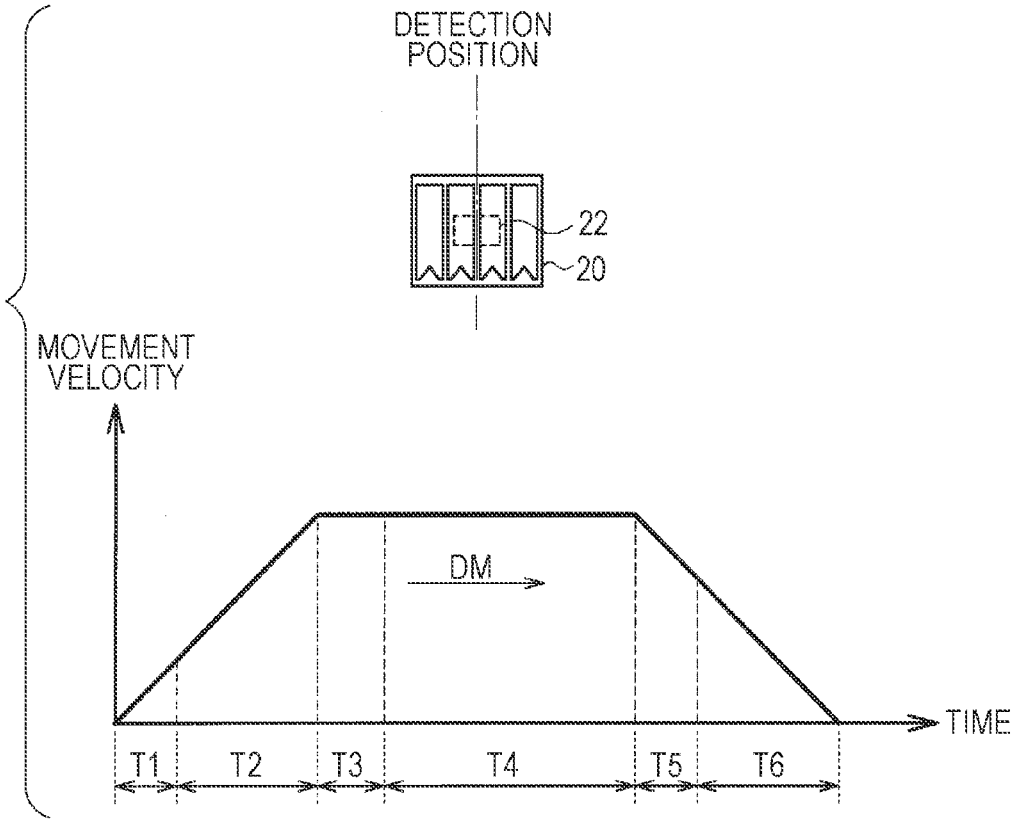
FIG. 14 is a descriptive diagram illustrating movement control of a carriage during forced detection control.

For example, FIG. 14 illustrates an example of movement control table data for the carriage 20. This table data is stored in the table data storage unit 192 shown in FIG. 7. The control unit 100 (the driving control unit 110) controls the carriage motor 50 (the driving unit) based on this table data.

In the table data shown in FIG. 14, a period T1 corresponds to a period immediately following the start of acceleration of the carriage 20, and thus the surface of the ink is unstable in this period T1. A period T2 corresponds to a period in which the carriage 20 is accelerating at a constant acceleration, and thus the surface of the ink is comparatively stable in the period T2. A period T3 is a period immediately following the end of acceleration, and thus the surface of the ink is slightly unstable. A period T4 corresponds to a period in which the carriage 20 is moving at a constant velocity, and the surface of the ink is stable. A period T5 is a period immediately following the start of deceleration, and thus the surface of the ink is slightly unstable. A period T6 corresponds to a period in which the carriage 20 is decelerating at a constant rate, and thus the surface of the ink is comparatively stable.

Accordingly, in this embodiment, the movement of the carriage 20 is controlled so that, for example, the ink cartridges pass through the detection position during the constant velocity period T4 in FIG. 14. Doing so makes it possible to detect whether the ink is near the end using the detection unit 80 in a state in which the surface of the ink is stable and shifting of the liquid surface is suppressed to a minimum. Accordingly, it is possible to detect whether the ink is near the end in a stable manner. Note that movement control may be carried out so that the ink cartridges pass through the detection position during, for example, a constant acceleration period or a constant deceleration period such as the period T2 or the period T6, and so on shown in FIG. 14. Doing so makes it possible to detect whether the ink is near the end in a state in which, for example, the surface of the ink is in a tilted but stable state.

Although the above describes an example of a case in which the method of this embodiment is applied in an on-carriage configuration in which the holder 21 that includes the ink cartridges and the head 22 are mounted on the carriage 20, the embodiment is not limited thereto. For example, the method can also be applied in an off-carriage printing apparatus, where the holder 21 in which the ink cartridges are mounted is not on the carriage 20 and is instead in a fixed position within the printing apparatus.

Figure 15:
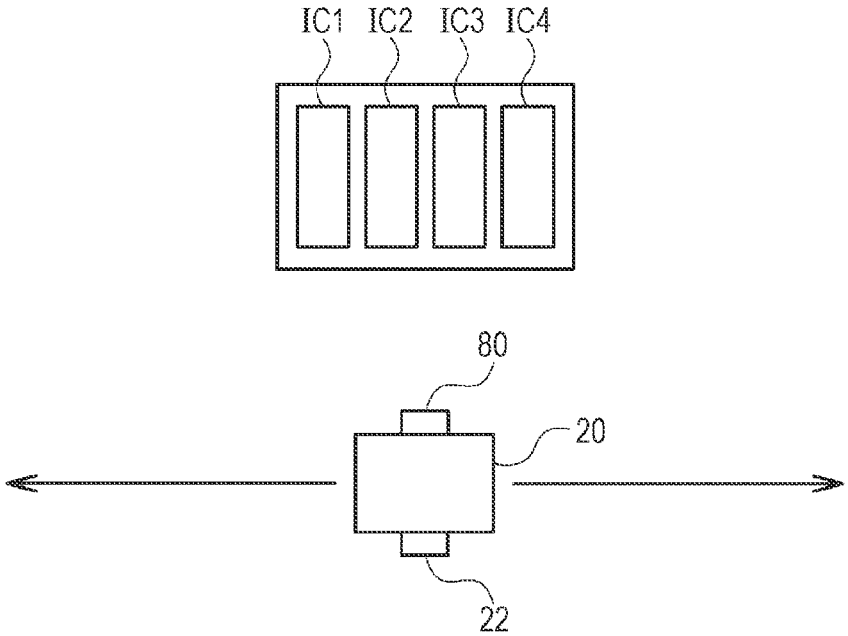
FIG. 15 is a descriptive diagram illustrating a method for moving a carriage in which a head and a detection unit are provided.

FIG. 15 illustrates a case in which the invention is applied in an off-carriage printing apparatus. The detection unit 80 is mounted on the carriage 20 that includes the head 22, and the carriage motor 50 causes the carriage 20, in which the head 22 and the detection unit 80 are mounted, to move so as to face the prism 320 of the ink cartridges. In this case, as the forced detection control, the control unit 100 controls the carriage motor 50 to move the carriage 20 that includes the detection unit 80 so that the detection unit 80, which is mounted on the carriage 20, and the ink cartridges arrive at the predetermined positional relationship (that is, a positional relationship in which the remaining state of the ink in the ink cartridges can be detected by the detection unit 80).

That is, in FIGS. 9A to 9C, the position of the detection unit 80 (that is, the detection position) is fixed, and the remaining state of the ink is detected by moving the ink cartridges that are mounted in the holder 21 of the carriage 20. However, in FIG. 15, the ink cartridges are fixed in the printing apparatus, and the remaining state of the ink is detected by the carriage 20, in which the head 22 and the detection unit 80 are mounted, moving due to driving performed by the carriage motor 50. Then, in the case where the forced detection control is carried out, the control unit 100 causes the carriage 20, in which the head 22 and the detection unit 80 are mounted, to move so that the ink cartridges and the detection unit 80 are in the predetermined positional relationship, and the remaining state of the ink is then detected. Doing so makes it possible to apply the method of this embodiment in a so-called off-carriage printing apparatus as well.

4.4 Detailed Processing Example

Figure 16:
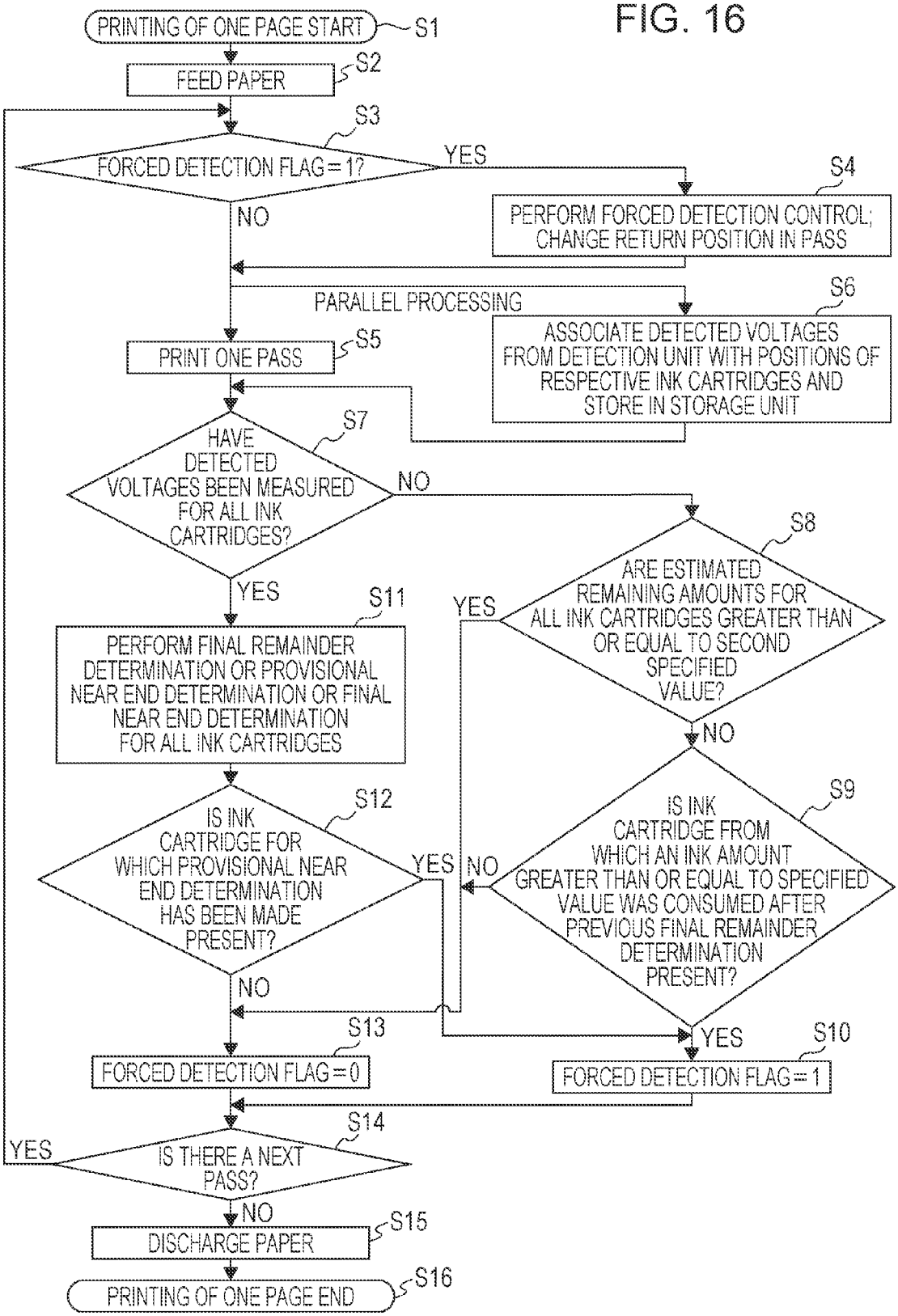
FIG. 16 is a flowchart illustrating a specific example of processing according to the embodiment.

Next, a detailed example of the processing according to this embodiment will be described using the flowchart in FIG. 16.

When the printing of one page starts (S1), first, the printing medium is fed (S2). Then, the control unit 100 determines whether or not a forced detection flag is 1 (that is, is set) (S3). The forced detection flag is a flag instructing whether or not to perform the forced detection control, and is stored in the flag storage unit 196 shown in FIG. 7.

In the case where the forced detection flag is 1, the control unit 100 performs the forced detection control illustrated in FIG. 9C and so on, and changes (extends) the return position of the printing pass (S4). In other words, when the forced detection flag is set to 1 in the previous pass, the control unit 100 performs control for forcing the detection unit 80 to perform detection by having all of the ink cartridges IC1 to IC4 pass through the detection position in the current pass.

Next, the control unit 100 performs one pass's worth of a printing process (S5). In addition, the control unit 100 performs a process for storing the detected voltages from the detection unit 80 in the storage unit 190 in association with the positions of the respective ink cartridges, in parallel with the one pass's worth of the printing process (S6). Specifically, data having a data structure such as that shown in FIG. 12 is loaded into the storage unit 190. Furthermore, although not shown in the drawings, the remaining amounts of ink in the ink cartridges are updated in the remaining amount storage unit 194 by the remaining amount estimation unit 150 with each printing pass.

Next, the control unit 100 determines whether or not the detected voltages have been measured for all of the ink cartridges IC1 to IC4 (S7). In other words, in this embodiment, whether or not the ink cartridges IC1 to IC4 and the detection unit 80 are in a positional relationship in which the detection can be carried out is determined based on whether or not the detected voltages from the detection unit 80 have been measured.

Then, in the case where an ink cartridge for which the detected voltage cannot be measured is present, the control unit 100 determines whether or not the estimated remaining amounts in all of the ink cartridges IC1 to IC4 are greater than or equal to the second specified value (S8). In other words, before the process for determining whether or not the forced detection control will be carried out in the next pass, the control unit 100 determines whether or not the remaining amounts of ink in the ink cartridges IC1 to IC4 as calculated by the remaining amount estimation unit 150 are sufficient (that is, are greater than or equal to the second specified value); in the case where the remaining amounts of ink are sufficient (that is, are greater than or equal to the second specified value), the forced detection control processing (that is, the process for determining whether or not to perform the forced detection control) is omitted, and the process moves to the next pass. In other words, the processes of steps S9 and S10 are omitted, and the processing advances to steps S13 and S14. To rephrase, in the case where the remaining amount of ink counted based on the dot count value is greater than or equal to the second specified value for all of the ink cartridges IC1 to IC4 and it has thus been estimated that a sufficient amount of ink remains, the forced detection process is not carried out. Doing so reduces the amount of processing performed in each printing pass and thus makes it possible to suppress a drop in the printing speed and the like.

In the case where the estimated remaining amount of ink is less than the second specified value, the control unit 100 determines whether or not there is an ink cartridge in which greater than or equal to the specified value of ink has been consumed following the final remainder determination up until the previous printing pass, performed in step S11 (S9). In other words, as indicated by G1, G2, and G3 in FIG. 10, it is determined whether or not greater than or equal to the specified value of ink has been consumed without the ink cartridges IC1 to IC4 and the detection unit 80 arriving at the predetermined positional relationship. Specifically, the control unit 100 estimates the amount of ink consumed based on the dot count value of the ink discharged from the head, and determines whether or not greater than or equal to the specified value of ink has been consumed following the previous final determination. The forced detection flag is set to 1 in the case where greater than or equal to the specified value of ink has been consumed (S10). As a result, the forced detection control is carried out in the next printing pass, as indicated by G4 in FIG. 10. In other words, it is determined in step S3 that the forced detection control flag is 1 in the next pass, the forced detection control is carried out in step S4, and the return position of the pass is changed.

In the case where it has been determined that the detected voltages have been successfully measured for all of the ink cartridges in step S7, the control unit 100 performs the final remainder determination, the provisional near end determination, or the final near end determination for all of the ink cartridges (S11). Specifically, the final remainder determination is performed in the case where the detected voltage of the detection unit 80 exceeds a threshold. However, the provisional near end determination is performed in the case where the detected voltage does not exceed the threshold. Then, in the case where the provisional near end determination has been made greater than or equal to a specified number of times in a row while repeating the routine from steps S3 to S14, the control unit 100 makes a final near end determination. For example, as shown in FIG. 5, the stated threshold is set to a voltage between the peak voltage Vpk1 and the minimum voltage Vmin. Then, in the case where the detected voltage exceeds the threshold (that is, in the case of the waveform SIK), it is judged that ink remains, and the control unit 100 performs the final remainder determination. However, the provisional near end determination is performed in the case where the detected voltage does not exceed the threshold (the case of the waveform SEP). Then, in the case where the provisional near end determination made when the detected voltage does not exceed the threshold has been made greater than or equal to a specified number of times in a row, the control unit 100 makes the final near end determination, and determines that the ink has been detected as being near the end.

Specifically, it is determined whether or not an ink cartridge for which the provisional near end determination has been made is present (S12), and in the case where an ink cartridge for which the provisional near end determination has been made is present, the forced detection flag is set to 1 (S10). Through this, in the case where the provisional near end determination has been made, the forced detection control is performed in the next pass until the specified number of times has been reached. On the other hand, in the case where an ink cartridge for which the provisional near end determination has been made is not present, the forced detection flag is reset to 0 (S13). It is then determined whether or not there is a next printing pass (S14), and the process returns to step S3 in the case where there is a next pass. However, in the case where there is not a next pass, the printing medium PA is discharged (S15).

Although the foregoing has described the embodiment of the invention in detail, one skilled in the art will easily recognize that many variations can be made thereon without departing from the essential spirit of the novel items and effects of the invention. Such variations should therefore be taken as being included within the scope of the invention. For example, terms ("ink cartridge", "ink", "printing apparatus", and the like) that appear along with different terms having broader or identical definitions ("liquid receptacle", "liquid", "liquid consuming apparatus", and the like) at least once in the specification or drawings can be replaced with those different terms in all parts of the specification or drawings. Furthermore, all combinations of the embodiment and variations fall within the scope of the invention.

In addition, although the foregoing embodiment describes an example in which the invention is applied in a printing apparatus and an ink cartridge, the invention may be used in liquid consuming apparatuses that eject or discharge other liquids aside from ink, and can also be applied in a liquid receptacle that holds such a liquid. The liquid receptacle of the invention can also be applied in various types of liquid consuming apparatuses including liquid ejecting heads that discharge minute liquid droplets. "Droplet" refers to the state of the liquid discharged from the liquid consuming apparatus, and is intended to include granule forms, teardrop forms, and forms that pull tails in a string-like form therebehind. Furthermore, the "liquid" referred to here can be any material capable of being ejected by the liquid consuming apparatus. For example, any matter can be used as long as the matter is in its liquid state, including liquids having high or low viscosity, sol, gel water, other inorganic solvents, organic solvents, liquid solutions, liquid resins, and fluid states such as liquid metals (metallic melts); furthermore, in addition to liquids as a single state of a matter, liquids in which the particles of a functional material composed of a solid matter such as pigments, metal particles, or the like are dissolved, dispersed, or mixed in a liquid solvent are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of such liquid consuming apparatuses: liquid consuming apparatuses that eject liquids including materials such as electrode materials, coloring materials, and so on in a dispersed or dissolved state for use in the manufacture and so on of, for example, liquid-crystal displays, EL (electroluminescence) displays, surface light emission displays, and color filters; liquid consuming apparatuses that eject bioorganic matters used in the manufacture of biochips; and liquid consuming apparatuses that are used as precision pipettes and eject liquids to be used as samples. Furthermore, the invention may be employed in liquid consuming apparatuses that perform pinpoint ejection of lubrication oils into the precision mechanisms of clocks, cameras, and the like; liquid consuming apparatuses that eject transparent resin liquids such as ultraviolet curing resins onto a substrate in order to form miniature hemispheric lenses (optical lenses) for use in optical communication elements; and liquid consuming apparatuses that eject an etching liquid such as an acid or alkali onto a substrate or the like for etching.

What is claimed is:

1. A liquid consuming apparatus comprising:

a liquid receptacle that holds a liquid;

a head that discharges the liquid supplied from the liquid receptacle;

a driving unit that performs driving that moves the head;

a detection unit that detects a remaining state of the liquid in the liquid receptacle when the liquid receptacle and the detection unit are in a predetermined positional relationship;

a control unit that controls the driving unit and that determines the remaining state of the liquid in the liquid receptacle based on a detection signal from the detection unit; and a storage unit that stores liquid amount information of the liquid receptacle;

wherein after the control unit determines there is liquid remaining in the liquid receptacle based on the detection signal from the detection unit, the control unit determines that the liquid amount consumed from the liquid receptacle is greater than or equal to a specified amount without the detection unit again detecting the remaining state of the liquid in the liquid receptacle, then the control unit performs forced detection control that sets the liquid receptacle and the detection unit to the predetermined positional relationship and causes the detection unit to detect the remaining state of the liquid;

wherein the control unit determines whether or not the liquid receptacle and the detection unit are in the predetermined positional relationship with each printing pass of the head, and after control unit determines there is liquid remaining in the liquid receptacle, the control unit determines that the liquid amount consumed from the liquid receptacle is greater than or equal to a specified amount without the detection unit again detecting the remaining state of the id in the liquid receptacle, the forced detection control is performed in the next printing pass of the head;

wherein in the case where the liquid receptacle and the detection unit are in the predetermined positional relationship in an ith printing pass of the head (where i is a natural number) and the control unit determines there is liquid remaining in the liquid receptacle, the storage unit stores the liquid amount information of the liquid receptacle as ith liquid amount information;

wherein in the case where the liquid receptacle and the detection unit are not in the predetermined positional relationship in a jth pass that follows the ith pass (where j is a natural number greater than i) and the amount of liquid consumed from the ith liquid amount information in the ith pass is less than the specified value, the control unit does not perform the forced detection control in a j+1th pass that follows the jth pass; and wherein in the case where the liquid receptacle and the detection unit are not in the predetermined positional relationship in a kth pass that follows the jth pass (where k is a natural number greater than i) and the amount of liquid consumed from the ith liquid amount information in the ith pass is greater than or equal to the specified value, the control unit performs the forced detection control in the k+1th pass that follows the kth pass.

2. The liquid consuming apparatus according to claim 1, wherein in the case where the remaining amount of liquid in the liquid receptacle is greater than or equal to a second specified value, the control unit omits the forced detection control processing and moves to the processing of the next pass.

3. The liquid consuming apparatus according to claim 1, wherein the control unit determines whether or not the liquid receptacle and the detection unit are in the predetermined positional relationship based on whether or not the detection signal from the detection unit indicating the remaining state of the liquid is measured, and in the case where it determined that greater than or equal to the specified value of the liquid from the liquid receptacle is consumed without the detection signal being measured, the control unit performs the forced detection control.

4. The liquid consuming apparatus according to claim 3, further comprising:

a plurality of types of liquid receptacles provided as the liquid receptacle, wherein the control unit performs the forced detection control in the case where it is determined that greater than or equal to the specified value of the liquid is consumed without the detection signal indicating the remaining state of the liquid being measured for at least one of the plurality of types of liquid receptacles.

5. The liquid consuming apparatus according to claim 3, wherein in the case where the detection signal is measured, the control unit determines whether or not there is liquid remaining in the liquid receptacle based on the measured detection signal, and in the case where it is determined that there is no liquid remaining, the control unit makes a provisional near end determination for the liquid in the liquid receptacle and performs the forced detection control, and the control unit makes a final near end determination for the liquid in the liquid receptacle in the case where the provisional near end determination is made greater than or equal to a specified number of times in succession.

6. The liquid consuming apparatus according to claim 1, wherein the control unit determines whether or not greater than or equal to the specified value of the liquid from the liquid receptacle is consumed by estimating the amount of liquid consumed based on a dot count value of the liquid discharged from the head.

7. The liquid consuming apparatus according to claim 1, wherein the liquid receptacle is mounted in a carriage that includes the head;

the driving unit performs driving that moves the carriage in which the head and the liquid receptacle are mounted; and the control unit performs, as the forced detection control, control that causes the driving unit to move the carriage so that the liquid receptacle mounted in the carriage and the detection unit are in the predetermined positional relationship.

8. The liquid consuming apparatus according to claim 7, wherein the control unit controls the driving unit so that the liquid receptacle and the detection unit are in the predetermined positional relationship during a period in which the carriage is moving at a constant velocity.

9. The liquid consuming apparatus according to claim 1, wherein the detection unit is mounted in a carriage that includes the head;

the driving unit performs driving that moves the carriage in which the head and the detection unit are mounted; and the control unit performs, as the forced detection control, control that causes the driving unit to move the carriage so that the detection unit mounted in the carriage and the liquid receptacle are in the predetermined positional relationship.

10. The liquid consuming apparatus according to claim 1, wherein the detection unit includes:

a light-emitting unit; and a light-receiving unit;

the liquid receptacle includes a prism that reflects light emitted from the light-emitting unit of the detection unit in accordance with the remaining state of the liquid; and the control unit detects the remaining state of the liquid in the liquid receptacle based on the detection signal that is obtained by the light-receiving unit of the detection unit receiving the light reflected by the prism.

* * * * *